US008414355B2

(12) United States Patent
Kimba et al.

(10) Patent No.: US 8,414,355 B2
(45) Date of Patent: Apr. 9, 2013

(54) SUBSTRATE PROCESSING APPARATUS

(75) Inventors: Toshifumi Kimba, Tokyo (JP); Hiroaki Kusa, Tokyo (JP)

(73) Assignee: Ebara Corporation, Tokyo (JP)

( * ) Notice: Subject to any disclaimer, the term of this patent is extended or adjusted under 35 U.S.C. 154(b) by 902 days.

(21) Appl. No.: 12/458,814

(22) Filed: Jul. 23, 2009

(65) Prior Publication Data

US 2010/0022166 A1 Jan. 28, 2010

(30) Foreign Application Priority Data

Jul. 25, 2008 (JP) ..... 2008-191882

(51) Int. Cl.
*B24B 49/00* (2012.01)
*B24B 51/00* (2006.01)
*G01B 11/00* (2006.01)

(52) U.S. Cl.
USPC ..... 451/5; 356/124; 356/239.7; 451/6; 451/8; 451/43; 451/44

(58) Field of Classification Search ..... 382/141; 451/5, 6, 8, 10, 11, 43, 44, 302; 356/124, 356/127, 237.1, 239.7, 237.2
See application file for complete search history.

(56) References Cited

U.S. PATENT DOCUMENTS 4,319,270 A * 3/1982 Kimura et al. ..... 348/125
5,604,583 A * 2/1997 Byron et al. ..... 356/124
5,613,894 A * 3/1997 Delle Vedove ..... 451/1
5,738,563 A * 4/1998 Shibata ..... 451/5
6,122,063 A * 9/2000 Berndt et al. ..... 356/623
6,174,222 B1 * 1/2001 Sato et al. ..... 451/44
6,749,377 B2 * 6/2004 Gottschald et al. ..... 409/132
6,813,536 B1 * 11/2004 Gottschald ..... 700/160
6,840,841 B2 1/2005 Hakomori
6,881,130 B1 * 4/2005 Stocker ..... 451/44
6,933,234 B2 8/2005 Nakamura et al.
7,004,821 B2 * 2/2006 Guillermin et al. ..... 451/43
7,066,787 B2 6/2006 Nakanishi et al.
7,497,762 B2 * 3/2009 Chae et al. ..... 451/6
7,528,922 B2 * 5/2009 Choo et al. ..... 349/187

(Continued)

FOREIGN PATENT DOCUMENTS

JP 7-276229 10/1995
JP 2999712 10/1997

(Continued)

OTHER PUBLICATIONS

Machine English translation of JP 2002-208572.

(Continued)

*Primary Examiner* — Timothy V Eley
(74) *Attorney, Agent, or Firm* — Wenderoth, Lind & Ponack, L.L.P.

(57) ABSTRACT

A substrate processing apparatus having a polishing unit for polishing a periphery of a substrate. The substrate processing apparatus includes: a polishing unit configured to polish a periphery of a substrate; an imaging module configured to take an image of the periphery of the substrate polished by the polishing unit; and an image processing section configured to inspect a polished state of the substrate based on the image taken by the imaging module. The imaging module is configured to take the image of the periphery of the substrate when the polishing unit is not polishing the periphery of the substrate.

16 Claims, 23 Drawing Sheets

U.S. PATENT DOCUMENTS

| | | | | |
|---|---|---|---|---|
| 2001/0000502 | A1* | 4/2001 | Stocker et al. | 451/44 |
| 2003/0169916 | A1 | 9/2003 | Hayashi et al. | |
| 2003/0190862 | A1* | 10/2003 | Chae et al. | 451/5 |
| 2005/0018280 | A1* | 1/2005 | Richardson | 359/368 |
| 2008/0200100 | A1 | 8/2008 | Takahashi et al. | |
| 2008/0274670 | A1 | 11/2008 | Tada et al. | |
| 2009/0117828 | A1* | 5/2009 | Hongo et al. | 451/6 |

FOREIGN PATENT DOCUMENTS

| | | |
|---|---|---|
| JP | 11-351850 | 12/1999 |
| JP | 2000-114329 | 4/2000 |
| JP | 2002-208572 | 7/2002 |
| JP | 2005-191179 | 7/2005 |
| JP | 2007-155448 | 6/2007 |
| JP | 2009-111079 | 5/2009 |
| WO | 2005/081301 | 9/2005 |
| WO | 2006/112530 | 10/2006 |

OTHER PUBLICATIONS

Machine English translation of JP 2007-155448.

* cited by examiner

SUBSTRATE PROCESSING APPARATUS

BACKGROUND OF THE INVENTION

1. Field of the Invention

The present invention relates to a substrate processing apparatus having a polishing unit for polishing a periphery of a substrate, and more particularly to a substrate processing apparatus having a mechanism for inspecting a polished surface.

2. Description of the Related Art

There is an increasing demand for a high throughput in a semiconductor-device fabrication process. Under such a demand, there has recently been developed a polishing apparatus having multiple polishing modules arranged so as to surround a substrate. This type of polishing apparatus realizes a high throughput by operating the multiple polishing modules simultaneously to polish a periphery of the rotating substrate. Generally, the polishing apparatus has a module for detecting an end point of polishing of a substrate. Examples of such a polishing-end-point detection module include a so-called in-situ polishing-end-point detection module which is incorporated in the polishing apparatus.

The polishing-end-point detection module of in-situ type is generally designed to monitor a film on the periphery of the substrate while the polishing modules are polishing the periphery of the substrate, and determine the polishing end point based on a time when the film is removed. Therefore, it is necessary to arrange the polishing-end-point detection module next to the polishing modules. However, since the plural polishing modules access the substrate during polishing of the substrate, there is no space for the polishing-end-point detection module to access the substrate. Moreover, in view of the fact that the high-throughput polishing apparatus polishes each substrate in several seconds, it becomes meaningless to detect the polishing end point during polishing.

Further, a polishing liquid (typically pure water), which is supplied to the substrate during polishing, can hinder the polishing-end-point detecting operation of the polishing-end-point detection module. There is an in-situ type which uses a transparent tape through which the periphery of the substrate is monitored, with a view to avoiding such an influence of the polishing liquid. In this type of module, the transparent tape is brought into contact with the periphery of the substrate while advancing the transparent tape, and polishing of the periphery of the substrate is monitored from the back of the transparent tape. However, this solution requires a highly-transparent tape and thus entails an increased cost.

SUMMARY OF THE INVENTION

The present invention has been made in view of the above drawbacks. It is therefore an object of the present invention to provide a substrate processing apparatus having a low-cost polished-state inspection unit suitable for use with a high-throughput polishing unit.

One aspect of the present invention for achieving the above object is to provide a substrate processing apparatus including: a polishing unit configured to polish a periphery of a substrate; an imaging module configured to take an image of the periphery of the substrate polished by the polishing unit; and an image processing section configured to inspect a polished state of the substrate based on the image taken by the imaging module. The imaging module is configured to take the image of the periphery of the substrate when the polishing unit is not polishing the periphery of the substrate.

In a preferred aspect of the present invention, the substrate processing apparatus further includes a polishing-condition determining section configured to determine a polishing condition in the polishing unit. An inspection result of the image processing section is transmitted to the polishing-condition determining section, and the polishing-condition determining section determines the polishing condition in the polishing unit based on the inspection result.

In a preferred aspect of the present invention, the imaging module is configured to take the image of the periphery of the substrate from multiple directions.

In a preferred aspect of the present invention, the imaging module includes a prism disposed adjacent to the periphery of the substrate and an imaging camera for taking the image of the periphery of the substrate through the prism.

In a preferred aspect of the present invention, the imaging module includes plural imaging cameras.

In a preferred aspect of the present invention, the image processing section is configured to inspect the polished state of the substrate based on a color of the image taken by the imaging module.

In a preferred aspect of the present invention, the image processing section is configured to quantify the color of the image taken by the imaging module to express the image in a numerical value, and further configured to determine that an object has been removed from the periphery when the numerical value is larger than or smaller than a preset threshold.

In a preferred aspect of the present invention, the substrate processing apparatus further includes a substrate holding rotary mechanism for rotating the substrate about its own central axis. The imaging module is disposed adjacent to the periphery of the substrate held by the substrate holding rotary mechanism, and the imaging module is configured to take the image of the periphery of the substrate while the substrate holding rotary mechanism rotates the substrate intermittently or continuously.

In a preferred aspect of the present invention, the imaging module is configured to take a still image of the periphery of the substrate.

In a preferred aspect of the present invention, the imaging module is configured to take an accumulated image of the periphery of the substrate.

In a preferred aspect of the present invention, the imaging module has a line scan camera.

In a preferred aspect of the present invention, the imaging module has multiple cameras with different fields of view.

In a preferred aspect of the present invention, the substrate processing apparatus further includes a measuring unit configured to measure a predetermined physical quantity of the substrate polished by the polishing unit. The imaging module is incorporated in the measuring unit.

In a preferred aspect of the present invention, the measuring unit has a substrate holding rotary mechanism for rotating the substrate about its own central axis, and the imaging module is disposed adjacent to the periphery of the substrate held by the substrate holding rotary mechanism.

In a preferred aspect of the present invention, the substrate processing apparatus further includes at least one post-processing unit configured to perform a post-process on the substrate polished by the polishing unit. The imaging module is incorporated in the at least one post-processing unit.

In a preferred aspect of the present invention, the at least one post-processing unit has a substrate holding rotary mechanism for rotating the substrate about its own central axis, and the imaging module is disposed adjacent to the periphery of the substrate held by the substrate holding rotary mechanism.

In a preferred aspect of the present invention, the substrate processing apparatus further includes a storage device for storing an inspection result of the image processing section.

In a preferred aspect of the present invention, the substrate processing apparatus further includes: a storage device for storing the image taken by the imaging module; and an image display device for displaying the image stored in the storage device.

In a preferred aspect of the present invention, the storage device stores the image and information indicating a position where the image was taken, and the image display device is configured to display an image in a position requested.

Another aspect of the present invention is to provide a substrate processing method including: polishing a periphery of a substrate; taking an image of the periphery of the substrate when the polishing of the periphery of the substrate is not performed; and inspecting a polished state of the substrate based on the image.

The present invention as described above can provide a so-called in-line inspection unit which can inspect the polished-state of the substrate independently of the polishing process after the polishing process is completed or after the polishing process is stopped temporarily. Therefore, the inspection is not affected by a polishing liquid (e.g., pure water) and a transparent tape is not required. This polished-state inspection unit of in-line type can be installed outside of the polishing unit. This arrangement does not necessitate a change in structure of the polishing unit. Therefore, the structure of the high-throughput polishing unit can be used as it is.

DETAILED DESCRIPTION OF THE PREFERRED EMBODIMENTS

Figure 1A:
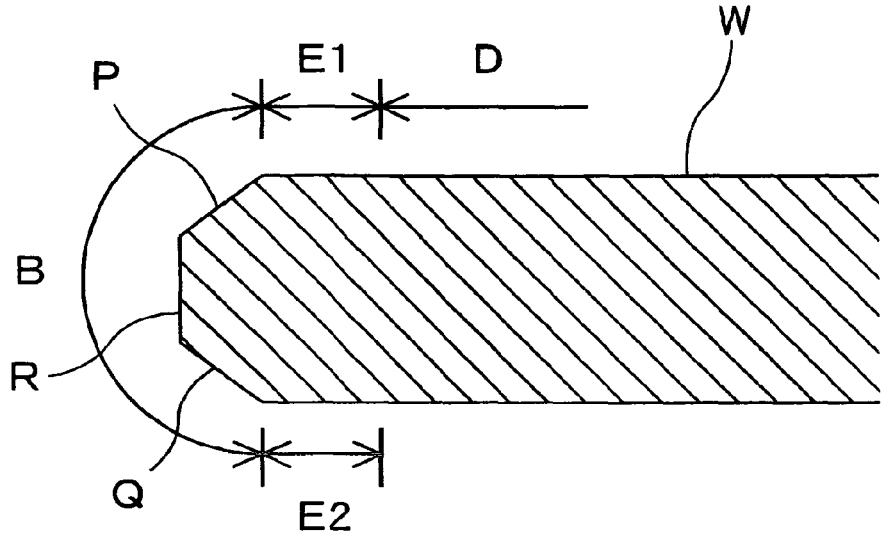
FIG. 1A and FIG. 1B are enlarged cross-sectional views each showing a periphery of a substrate, such as a semiconductor wafer.
Figure 1B:
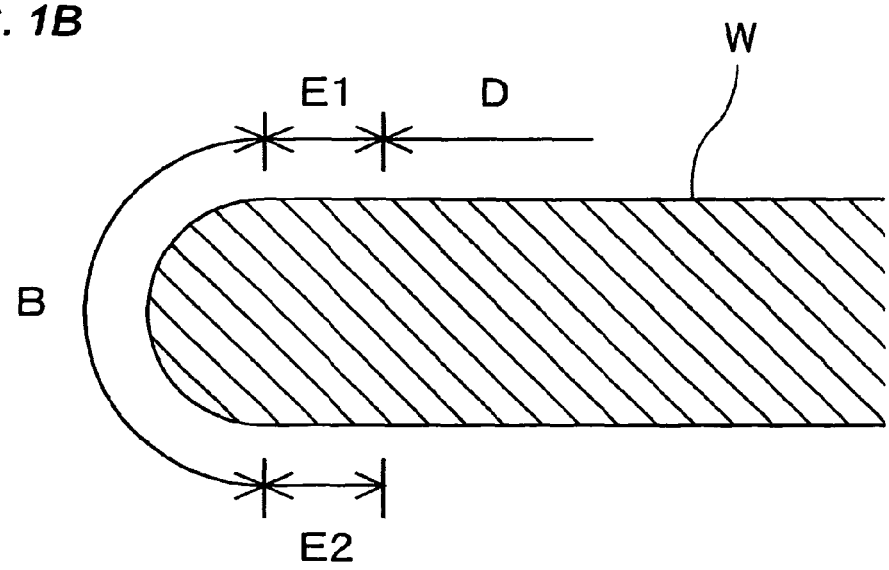

Embodiments of the present invention will be described below with reference to the drawings. FIG. 1A and FIG. 1B are enlarged cross-sectional views each showing a periphery of a substrate, such as a semiconductor wafer (which will be hereinafter referred to simply as "wafer"). More specifically, FIG. 1A shows a cross-sectional view of a so-called straight-type wafer W having a periphery whose cross section is constituted by straight lines, and FIG. 1B shows a so-called round-type wafer W having a periphery whose cross section is constituted by curved lines.

In the wafer W shown in FIG. 1A, a bevel portion is an area B that is constituted by an upper slope (an upper bevel portion) P, a lower slope (a lower bevel portion) Q, and a side portion (an apex) R. In the wafer W shown in FIG. 1B, a bevel portion is an area B that forms a circumferential surface of the wafer W and has a curved cross section. A near-edge portion is an area located radially inwardly of the bevel portion B of the wafer W and is indicated by flat portions E1 and E2 located radially outwardly of an area D where devices are formed. In this specification, the periphery of the wafer means a region including the bevel portion B and the near-edge portions E1 and E2. Further, in this specification, the upper near-edge portion E1 is referred to as a top near-edge portion and the lower near-edge portion E2 is referred to as a back near-edge portion.

Figure 2:
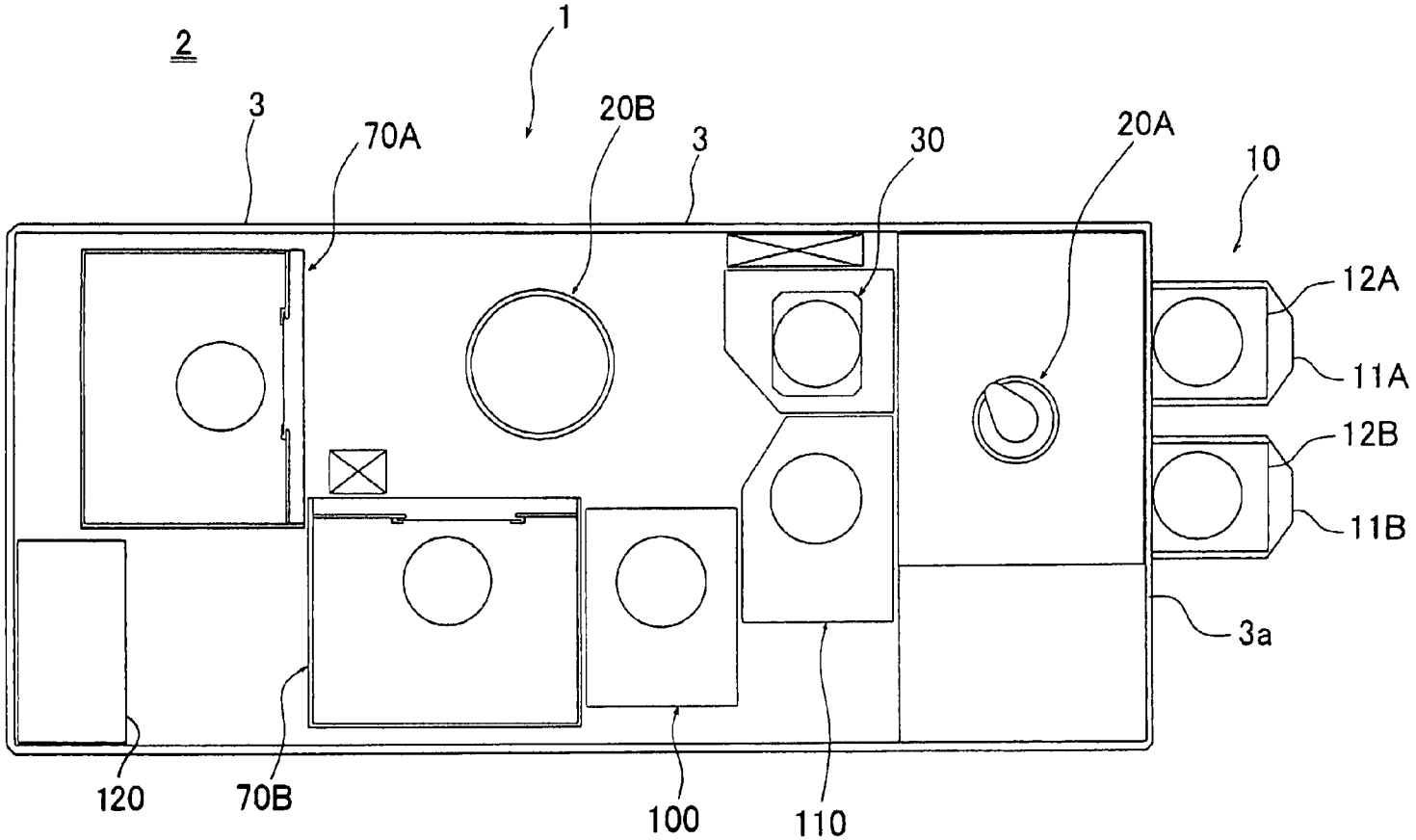
FIG. 2 is a schematic plan view showing a whole structure of a substrate processing apparatus according to an embodiment of the present invention.

FIG. 2 is a schematic plan view showing a whole structure of a substrate processing apparatus according to an embodiment of the present invention. The substrate processing apparatus 1 shown in FIG. 2 includes a load-unload port 10 in which wafer supply-recovery devices 11A and 11B are installed, a measuring unit 30 for measuring a diameter of a wafer, and a first transfer robot 20A for transporting a wafer mainly between the load-unload port 10, the measuring unit 30, and a secondary cleaning-drying unit 110 which will be discussed later. The substrate processing apparatus 1 further includes a first polishing unit 70A and a second polishing unit 70B for polishing the periphery of the wafer, a primary cleaning unit 100 for performing a primary cleaning process on the polished wafer, the secondary cleaning-drying unit 110 for performing a secondary cleaning process on the primarily-cleaned wafer and performing a drying process on the secondarily-cleaned wafer, and a second transfer robot 20B for transporting the wafer mainly between the first and second polishing units 70A and 70B, the primary cleaning unit 100, and the secondary cleaning-drying unit 110.

The substrate processing apparatus 1 further includes a polishing-condition determining section 120 for determining polishing conditions in the first and second polishing units 70A and 70B based on a measurement result of the wafer in the measuring unit 30. Specifically, the polishing-condition determining section 120 is part of a controller and is a calculator for calculating the polishing conditions based on the measurement result of the periphery of the wafer.

Every unit of the substrate processing apparatus 1 is arranged in a housing 3 which is installed in a clean room 2. An interior space of the clean room 2 and an interior space of the substrate processing apparatus 1 are partitioned by the housing 3. A non-illustrated filter is provided on a top of the housing 3, so that a clean air is introduced into the housing 3 to form downflow of the clean air therein and is expelled to the exterior of the housing 3 through an exhaust port (not shown in the drawing) provided on a bottom of the housing 3. In this manner, the air flow in the substrate processing apparatus 1 is controlled so as to be suited for the substrate processing. In addition, the units in the housing 3 are further housed in housings, respectively, so that air flow in each housing is controlled so as to be suited for the substrate processing.

The load-unload port 10 is installed outwardly of a side wall 3*a* that is located adjacent to the first transfer robot 20A. In this load-unload port 10, the two wafer supply-recovery devices 11A and 11B are disposed in parallel. The wafer supply-recovery devices 11A and 11B are referred to as FOUP (Front Opening Unified Pod) configured to supply and recover a wafer (i.e., an object to be processed) to and from the substrate processing apparatus. When a wafer cassette (or wafer carrier) 12A or 12B, which houses plural wafers therein, is placed onto the wafer supply-recovery device 11A or 11B, a lid of the wafer cassette 12A or 12B is opened automatically and a window (not shown) on the side wall 3*a* is opened, so that the first transfer robot 20A can remove a wafer from the wafer cassette 12A or 12B and transport the wafer into the substrate processing apparatus 1.

Figure 3A:
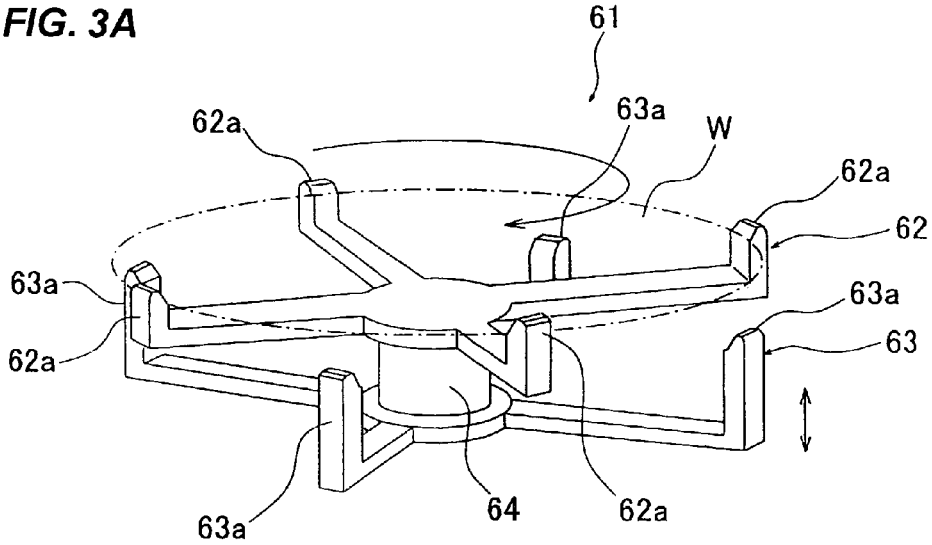
FIG. 3A is a schematic perspective view showing a substrate holding rotary mechanism provided in a measuring unit.
Figure 3B:
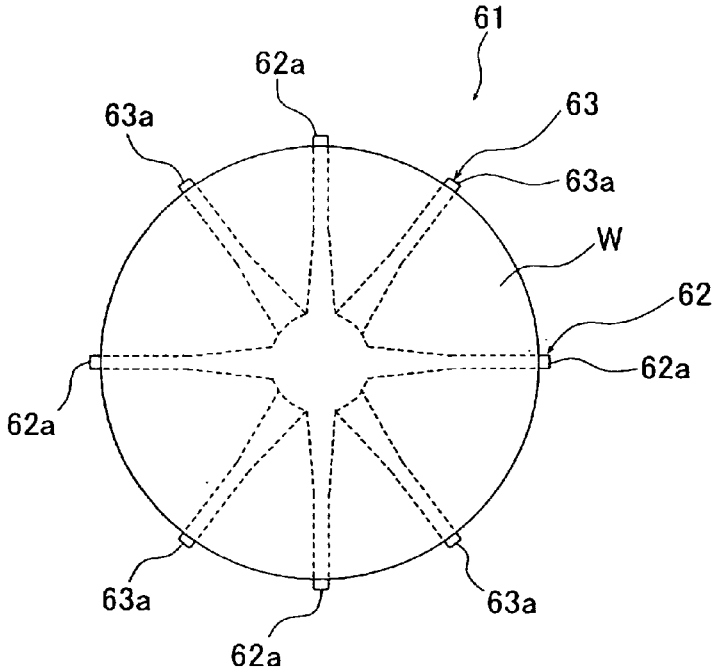
FIG. 3B is a schematic plan view showing the substrate holding rotary mechanism.

FIG. 3A is a schematic perspective view showing a substrate holding rotary mechanism provided in the measuring unit 30 which will be discussed later, and FIG. 3B is a schematic plan view showing the substrate holding rotary mechanism. The substrate holding rotary mechanism 61 is a device for holding and rotating the wafer W when the measuring unit 30 is performing its measuring operation. The substrate holding rotary mechanism 61 includes an upper chuck (or upper spin chuck) 62 with plural claws 62*a* for holding the periphery of the wafer W and a lower chuck (or lower spin chuck) 63 with plural claws 63*a* for holding the periphery of the wafer W similarly. The upper chuck 62 and the lower chuck 63 are arranged concentrically and are rotatable about a rotational shaft 64.

The claws 62*a* and 63*a* of the upper and lower chucks 62 and 63 are three or four claws arranged at predetermined intervals. As shown FIG. 3A, the lower chuck 63 is movable vertically by a non-illustrated elevating mechanism. The substrate holding rotary mechanism 61 further includes a stepping motor as a rotating device for rotating the upper chuck 62 and the lower chuck 63 and a rotary encoder as a rotational position detector for detecting a rotational position or a rotational angle of the wafer W, as will be described later.

Figure 4A:
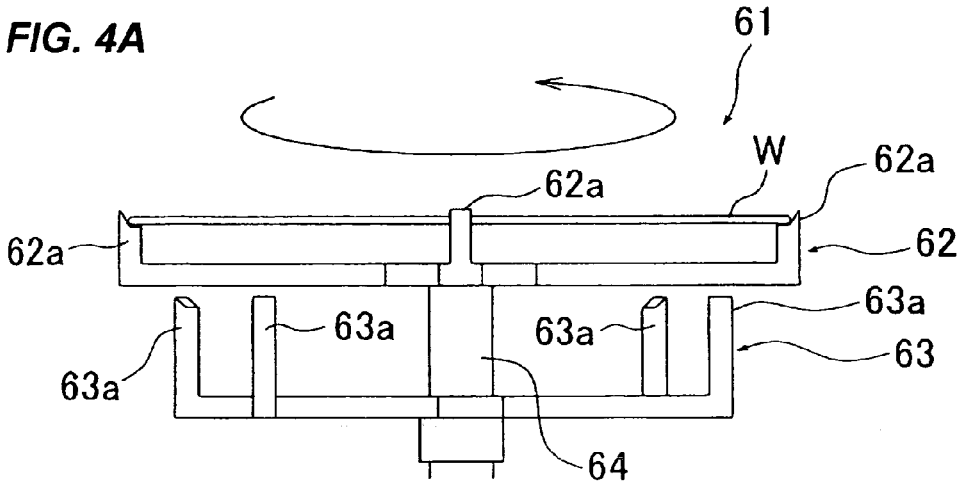
FIG. 4A and FIG. 4B are views illustrating operations of the substrate holding rotary mechanism.
Figure 4B:
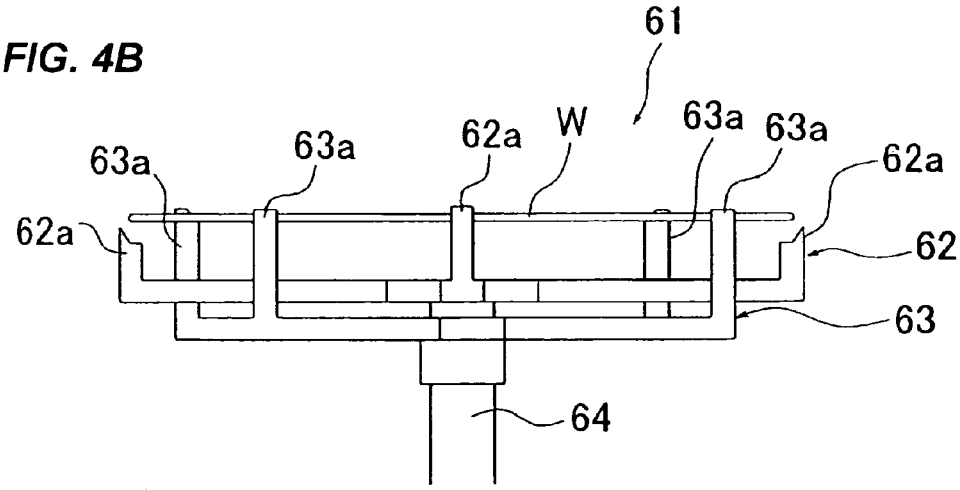

Next, operations of the substrate holding rotary mechanism 61 will be described with reference to FIG. 4A and FIG. 4B. Basically, as shown in FIG. 4A, the upper chuck 62 holds and rotates the wafer W when measuring the diameter of the wafer W. As the upper chuck 62 is rotated, the claw 62*a* can reach a measuring position of the periphery of the wafer W. Thus, before the claw 62*a* reaches the measuring position, the lower chuck 63 is elevated to hold the wafer W as shown in FIG. 4B, whereby the wafer W is separated from the upper chuck 62. In this state, the upper chuck 62 is rotated through a predetermined angle, so that the claw 62*a* can avoid overlapping the measuring position. After the claw 62*a* of the upper chuck 62 passes the measuring position, the lower chuck 63 is lowered to allow the upper chuck 62 to hold the wafer W again. Because these operations can prevent the claws 62*a* of the upper chuck 62 from overlapping the measuring position, the diameter of the wafer W can be measured over the periphery of the wafer W in its entirety.

Figure 5:
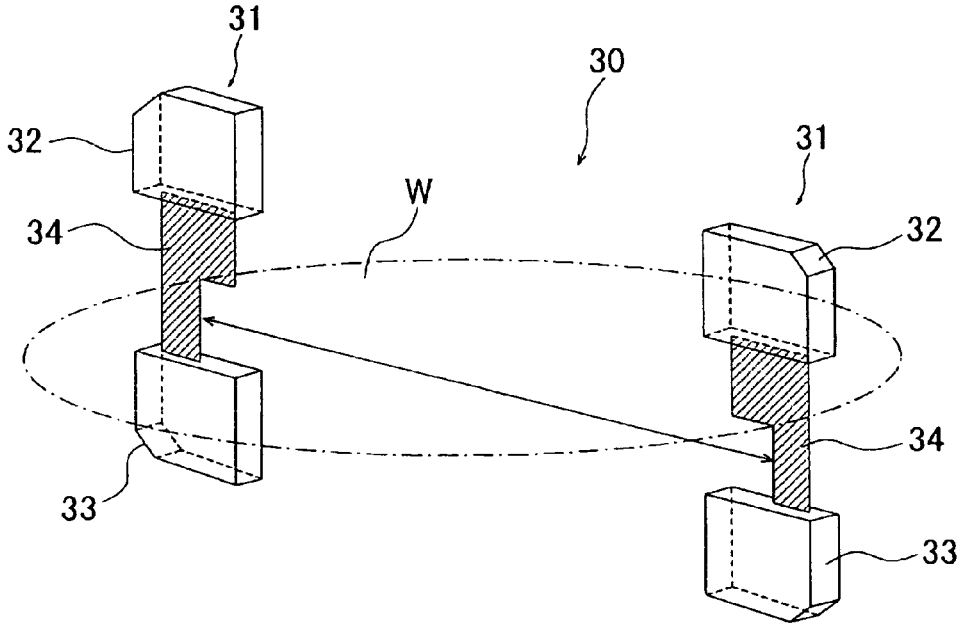
FIG. 5 is a schematic perspective view showing the measuring unit.
Figure 6A:
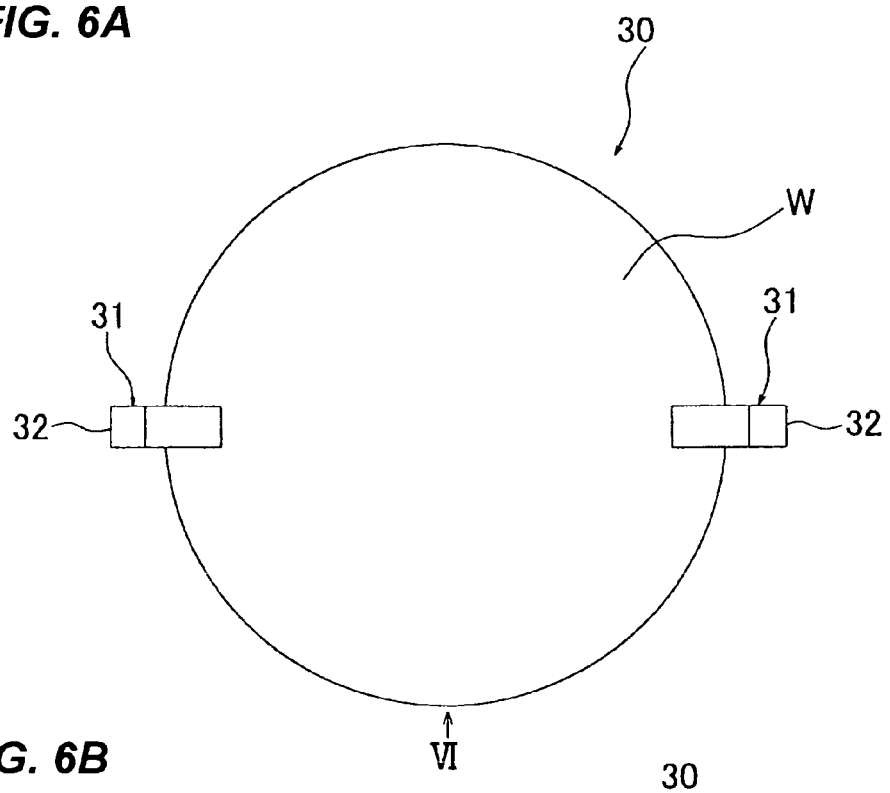
FIG. 6A is a schematic plan view of the measuring unit.
Figure 6B:
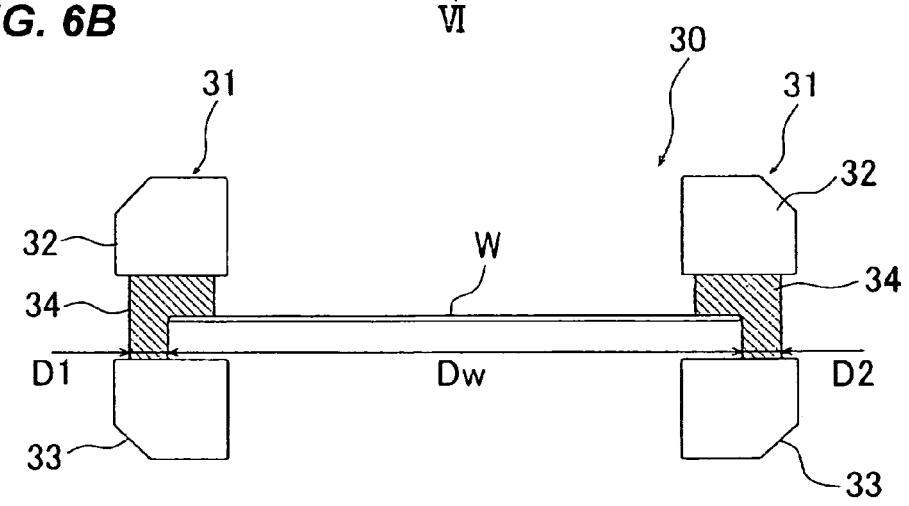
FIG. 6B is a view from a direction as indicated by arrow VI in FIG. 6A.

FIG. 5 is a schematic perspective view showing the measuring unit 30. FIG. 6A is a schematic plan view of the measuring unit 30, and FIG. 6B is a view from a direction as indicated by arrow VI in FIG. 6A. In FIG. 5 and FIGS. 6A and 6B, the substrate holding rotary mechanism 61 is not depicted.

This measuring unit 30 has a diameter-measuring device configured to measure a dimension (i.e., a diameter) of the wafer W and is provided for determining from the measured diameter an amount of material removed from the side portion of the wafer W by the polishing process. The measuring unit 30 includes the substrate holding rotary mechanism 61 and sensor devices (laser sensors) 31 and 31 each having a pair of a light emitter 32 and a light receiver 33 arranged at their predetermined positions above and below the periphery of the wafer W held by the substrate holding rotary mechanism 61. The light emitter 32 is a device that emits laser light.

In this embodiment, the two sensor devices 31 and 31 are provided. These sensor devices 31 and 31 are arranged in symmetric positions on a center line of the wafer W held by the substrate holding rotary mechanism 61. The sensor devices 31 and 31 are coupled to a data processor (not shown), which is configured to quantify amounts of the laser lights received by the light receivers 33 and 33 and process the quantified amounts of the laser lights. The light receivers 33 and 33 may be located above the wafer W and the light emitters 32 and 32 may be located below the wafer W.

As shown in FIG. 6B, the light emitters 32 and 32 of the sensor devices 31 and 31 emit the laser lights 34 and 34 downwardly toward the periphery of the wafer W. The laser lights 34 and 34 are a liner light (or a sheet-shaped light) with a predetermined width. Each laser light 34 impinges upon the periphery of the wafer W along the radial direction thereof and part of the laser light 34 is interrupted by an upper surface of the periphery of the wafer W. Therefore, the other part of the laser light 34, which is not interrupted by the wafer W and has traveled outwardly of the wafer W, is received by the light receiver 33. The data processor quantifies or expresses numerically the amounts of the laser lights 34 and 34 received by the light receivers 33 and 33 to determine widths of the laser lights 34 and 34 that have traveled through the periphery of the wafer W, i.e., measure dimensions of D1 and D2 shown in FIG. 6B. In order to determine the diameter of the wafer W, a reference wafer (not shown) with a known diameter is prepared, and the dimensions of D1 and D2 with respect to the reference wafer are measured in advance by the measuring unit 30. The diameter Dw of the wafer W (i.e., a wafer to be measured) can be determined from a difference between the dimensions D1 and D2 of the reference wafer and the dimensions D1 and D2 of the wafer W and the known diameter of the reference wafer.

The diameter of the wafer W can be measured at different points on the periphery of the wafer W by changing the rotational position (i.e., orientation) of the wafer W by the upper chuck 62 and the lower chuck 63 of the substrate holding rotary mechanism 61. With this operation, information (e.g., variation in an amount of material removed from the periphery of the wafer W), which is not available by single-point measurement, can be obtained. Further, the diameter of the wafer W can be measured continuously with the wafer W being rotated by the substrate holding rotary mechanism 61. According to this measuring method, the measurement data of the diameter can be obtained as continuous data. Therefore, roundness of the wafer can be determined.

Figure 7:
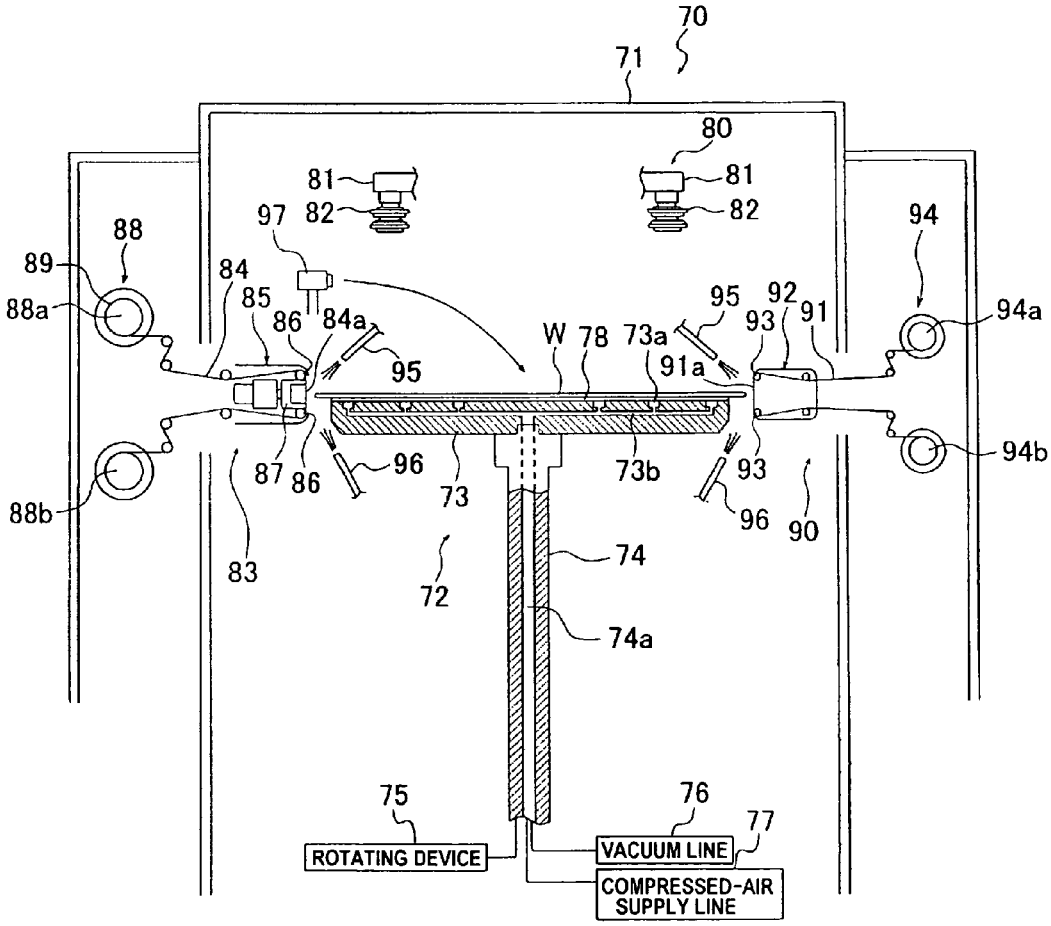
FIG. 7 is a schematic cross-sectional view showing a first polishing unit.

Next, the first polishing unit 70A and the second polishing unit 70B will be described. The first and second polishing units 70A and 70B have a common structure. Therefore, the first polishing unit 70A will be discussed below. FIG. 7 is a schematic cross-sectional view showing the first polishing unit. As shown in FIG. 7, the first polishing unit 70A has a housing 71 in which components of the polishing unit 70A are housed. The first polishing unit 70A includes a substrate holding rotary section 72 for holding a rear surface of the wafer W by a vacuum suction, a substrate-transferring mechanism 80 for performing centering and transferring of the wafer W, a bevel polishing section 83 for polishing the bevel portion of the wafer W, and a notch polishing section 90 for polishing a notch portion of the wafer W.

The substrate holding rotary section 72 has, as shown in FIG. 7, a substrate-holding table 73 having an upper surface with grooves 73*a* for attracting the wafer W by the vacuum suction, and a support shaft 74 that supports the substrate-holding table 73. A rotating device (i.e., a stage-rotating device) 75 is coupled to the support shaft 74, so that the substrate-holding table 73 and the support shaft 74 are rotated in unison by the rotating device 75. The grooves 73*a* of the substrate-holding table 73 are in fluid communication with a communication passage 73*b* formed in the substrate-holding table 73, and the communication passage 73*b* is in fluid communication with a communication passage 74*a* formed in the support shaft 74. The communication passage 74*a* is coupled to a vacuum line 76 and a compressed-air supply line 77. A non-illustrated elevating mechanism is coupled to the substrate-holding table 73 and the support shaft 74. The substrate-holding table 73 is moved in the vertical direction by this elevating mechanism.

An absorption pad 78, which is made of an elastic material (e.g., urethane-base material), is attached to the upper surface of the substrate-holding table 73 so as to cover the grooves 73*a*. This absorption pad 78 has a number of through-holes (not shown) each having a small diameter. These through-holes are in fluid communication with the grooves 73*a* of the substrate-holding table 73. Therefore, when the fluid communication is established between the vacuum line 76 and the communication passage 74*a*, the vacuum is developed in the through-holes of the absorption pad 78, and the wafer W on the absorption pad 78 is attracted to an upper surface of the absorption pad 78 due to the vacuum suction. This absorption pad 78 has the function of producing the vacuum between the wafer W and the substrate-holding table 73 and the function of reducing an impact on the wafer W when the wafer W is placed onto the substrate-holding table 73.

The substrate-transferring mechanism 80 is located above the substrate holding rotary section 72. The substrate-transferring mechanism 80 has a pair of arms 81 and 81. Plural cylindrical members 82, each having a recessed surface corresponding to the bevel portion of the wafer W, are secured to the respective arms 81 and 81. The arms 81 and 81 are movable toward and away from each other and can stop at a close position and an open position. The arms 81 and 81 hold the wafer W with the cylindrical members 82 at the close position and release the wafer W at the open position. By holding the wafer W with the arms 81 and 81 therebetween, centering of the wafer W is conducted. The substrate-holding table 73 is elevated by the elevating mechanism to receive the wafer W from the substrate-transferring mechanism 80, and holds the wafer W thereon by the vacuum suction and is lowered to a polishing position.

The bevel polishing section 83 includes a bevel polishing head 85 configured to press a polishing tape 84 against the bevel portion of the wafer W, and a polishing-tape feeding mechanism 88. This polishing-tape feeding mechanism 88 includes a supply reel 88*a* for supplying the polishing tape 84 to the bevel polishing head 85 and a recovery reel 88*b* for recovering the polishing tape 84 from the bevel polishing head 85. The bevel polishing head 85 has a pair of guide rollers 86 and 86 on which the polishing tape 84 rides so as to face the substrate-holding table 73. The polishing tape 84 extends in tension between the guide rollers 86 and 86, and the bevel polishing head 85 brings a polishing surface 84*a* of the polishing tape 84 into contact with the bevel portion of the wafer W. A base 87 is provided at the back of the polishing tape 84 extending between the guide rollers 86 and 86. This base 87 has a contact surface that is brought into contact with the polishing tape 84. Although not shown in the drawing, an elastic member may be attached to the contact surface of the base 87. The bevel polishing head 85 is movable in the radial direction of the wafer W by a non-illustrated moving mechanism. The polishing surface 84*a* of the polishing tape 84 is pressed against the bevel portion of the wafer W by a combination of an action of the base 87 that presses the polishing tape 84 from behind and the tension of the polishing tape 84 itself.

The polishing tape 84 is a band-shaped member with a constant width and has a length of several tens of meters. The polishing tape 84 is wound on a cylindrical core 89. This core 89 is attached to the supply reel 88*a*. The polishing tape 84 extends between the pair of the guide rollers 86 and 86 of the bevel polishing head 85 with the polishing surface 84*a* facing outward. One end of the polishing tape 84 is attached to the recovery reel 88*b*. A non-illustrated rotating mechanism, such as a motor, is coupled to the recovery reel 88*b*, so that the polishing tape 84 is wound and recovered with a predetermined tension applied by the rotating mechanism. When polishing the bevel portion, the polishing tape 84 is sent from the supply reel 88*a* continuously, whereby a new polishing surface 84*a* is supplied to the bevel polishing head 85 at all times.

The polishing surface 84*a* of the polishing tape 84 is manufactured by coating one surface of a tape base with a resin material containing abrasive grains dispersed therein and then solidifying the resin material. Diamond or SiC may be used as the abrasive grains. Type and grain size of the abrasive grains are selected according to the type of the wafer to be polished and a polishing degree required. For example, diamond with a grain size in a range of #4000 to #20000 or SiC with a grain size in a range of #4000 to #10000 can be used. Instead of the polishing tape 84, a band-shaped polishing cloth having a polishing surface with no grains attached may be used. Further, different types of polishing tapes may be set in the first polishing unit 70A and the second polishing unit 70B, respectively. In this case, different polishing processes can be performed.

Figure 8A:
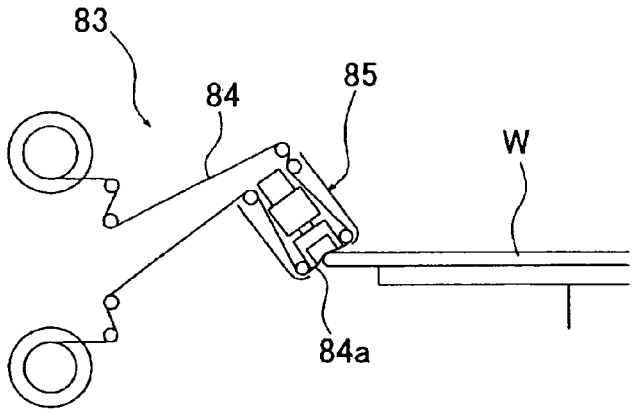
FIG. 8A through FIG. 8C are views illustrating motions of a bevel polishing head during polishing of a bevel portion.
Figure 8B:
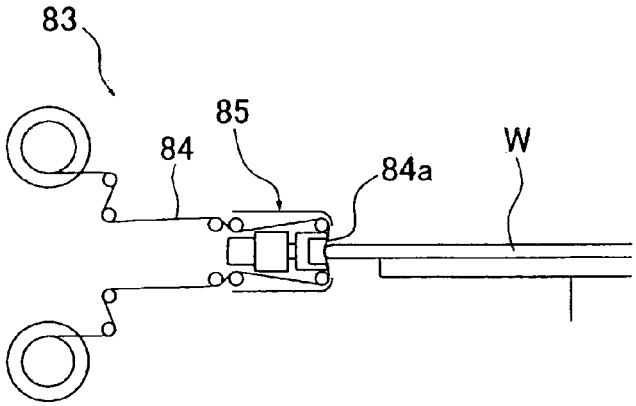
Figure 8C:
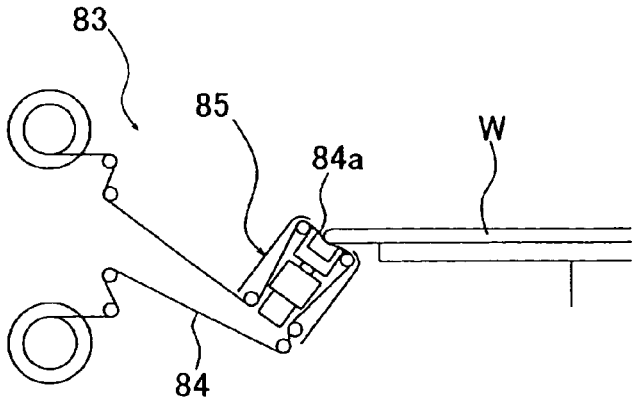

FIG. 8A through FIG. 8C are views illustrating motions of the bevel polishing head 85 during polishing of the bevel portion. The bevel polishing section 83 has an oscillation mechanism for causing the bevel polishing head 85 to oscillate vertically about a polishing point on the bevel portion of the wafer W, so that the polishing surface 84*a* of the polishing tape 84 can contact the bevel portion with the polishing head 85 inclined vertically at a predetermined angle with respect to the wafer surface. Therefore, as shown in FIG. 8A, the upper slope of the bevel portion and the top near-edge portion can be polished by inclining the polishing head 85 upwardly at predetermined angles with respect to the wafer surface. Similarly, as shown in FIG. 8B, the side portion of the bevel portion can be polished by keeping the polishing head 85 horizontally, and as shown in FIG. 8C, the lower slope of the bevel portion and the back near-edge portion can be polished by inclining the polishing head 85 downwardly at predetermined angles with respect to the wafer surface. Further, the upper and lower slopes and the side portion of the bevel portion, and the boundaries thereof can be polished to have desired angles and shapes by fine adjustment of the tilt angle of the bevel polishing head 85.

The notch polishing section 90 includes a notch polishing head 92 configured to press a polishing tape 91 against the notch portion of the wafer W, and a polishing-tape feeding mechanism 94. The notch polishing head 92 is movable in the radial direction of the wafer W by a non-illustrated moving mechanism. The polishing-tape feeding mechanism 94 includes a supply reel 94*a* for supplying the polishing tape 91 to the notch polishing head 92 and a recovery reel 94*b* for recovering the polishing tape 91 from the notch polishing head 92. The notch polishing head 92 has a pair of guide rollers 93 and 93 on which the polishing tape 91 rides. The polishing tape 91 extends in tension between the guide rollers 93 and 93, and the notch polishing head 92 brings a polishing surface 91*a* of the polishing tape 91 into contact with the notch portion of the wafer W.

The polishing tape 91 to be used in the notch polishing section 90 is made of the same material as the polishing tape 84 used in the bevel polishing section 83. The polishing tape 91 has a width that corresponds to a shape of the notch portion of the wafer W. The width of the polishing tape 91 for use in the notch polishing section 90 is smaller than the width of the polishing tape 84 for use in the bevel polishing section 83. Similarly to the bevel polishing section 83, the notch polishing section 90 has an oscillation mechanism (not shown in the drawing and not described in detail herein) for causing the notch polishing head 92 to oscillate vertically about a polishing point on the notch portion of the wafer W, so that the polishing surface 91*a* of the polishing tape 91 can contact the notch portion with the notch polishing head 92 inclined at a predetermined angle with respect to the wafer surface during polishing. Therefore, the notch polishing head 92 can polish the notch portion along its surface shape, and can also polish the notch portion to desired angle and shape. The notch polishing section 90 further includes a notch detecting device (not shown) for detecting the notch portion of the wafer W.

The first polishing unit 70A has, as shown in FIG. 7, polishing-water supply nozzles 95 and 96 for supplying water (i.e., polishing water), such as ultrapure water, onto the upper surface and the lower surface of the wafer W at positions near the polishing points. Further, the first polishing unit 70A has a polishing-water supply nozzle 97 for supplying the polishing water onto the center of the upper surface of the wafer W. This polishing-water supply nozzle 97 is located above the substrate-holding table 73. Supply of the polishing water from the polishing-water supply nozzles 95 and 96 during polishing of the bevel portion and the notch portion can prevent polishing debris (i.e., particles produced by the polishing process) from adhering to the upper surface and the lower surface of the wafer W.

The polishing water from the polishing-water supply nozzle 97 is supplied toward the center of the wafer W, and flows from the center to the periphery of the wafer W by the rotation of the wafer W. This flow of the polishing water serves to sweep away the polishing debris to the periphery of the wafer W. On the other hand, the lower polishing-water supply nozzle 96 supplies the polishing water onto an exposed portion of the lower surface of the wafer W that is located outwardly of the substrate-holding table 73. By supplying the polishing water onto the exposed portion of the wafer W, the polishing water can flow toward the periphery of the wafer W by the rotation of the wafer W to thereby carry the polishing debris to the periphery of the wafer W.

The polishing water, supplied from the polishing-water supply nozzles 95 and 96, not only has the function of preventing contamination of the upper and lower surfaces of the wafer W due to the polishing debris, but also has the cooling function of removing heat generated by friction during polishing of the wafer W. Therefore, heat of the polished portion of the wafer W can be removed by adjusting a temperature of the polishing water to be supplied. Consequently, a stable polishing operation can be performed.

Next, the polishing operations of the polishing unit 70A with the above-described configurations will be described. The wafer W, to be polished, is carried into the housing 71 and transported to the substrate-transferring mechanism 80. The arms 81 and 81 of the substrate-transferring mechanism 80 are closed to hold the wafer W, whereby centering of the wafer W is performed. Then, the substrate-holding table 73 is elevated to the position of the substrate-transferring mechanism 80, and attracts the wafer W, held by the arms 81 and 81, by the vacuum suction. At the same time as the wafer W is held by the vacuum suction, the arms 81 and 81 are opened to release the wafer W, whereby the wafer W is held on the upper surface of the substrate-holding table 73. Thereafter, the substrate-holding table 73, holding the wafer W, is lowered to the polishing position as shown in FIG. 7. Then, the rotating device 75 is set in motion to rotate the wafer W together with the substrate-holding table 73.

In this state, the supply reel 88*a* of the bevel polishing section 83 supplies the polishing tape 84 to the bevel polishing head 85 to set an unused polishing surface 84*a* between the guide rollers 86 and 86 of the bevel polishing head 85. Then, the bevel polishing head 85 is moved toward the wafer W by the moving mechanism to bring the polishing surface 84*a* of the polishing tape 84 into contact the bevel portion of the wafer W, thereby polishing the bevel portion. During polishing of the bevel portion, the oscillation mechanism of the bevel polishing section 83 is operated to cause the bevel polishing head 85 to oscillate vertically. With this motion, not only the bevel portion but also the near-edge portions of the wafer W can be polished.

Polishing of the notch portion of the wafer W is performed as follows. First, the notch portion of the wafer W is detected by the notch detecting device, and the wafer W is rotated until the notch portion faces the notch polishing head 92, whereby positioning of the notch portion is completed. After the positioning is terminated, the supply reel 94*a* of the notch polishing section 90 supplies the polishing tape 91 to the notch polishing head 92 to set an unused polishing surface 91*a* between the guide rollers 93 and 93 of the notch polishing head 92. Then, the notch polishing head 92 is moved toward the wafer W by the moving mechanism to bring the polishing surface 91*a* of the polishing tape 91 into contact the notch portion of the wafer W, thereby polishing the notch portion. During polishing of the notch portion, the oscillation mechanism of the notch polishing section 90 is operated to cause the polishing head 92 to oscillate vertically. Further, during polishing of the notch portion, the polishing-tape feeding mechanism 94 may move the polishing tape 91 back and forth slightly so as to bring the polishing tape 91 into sliding contact with the notch portion.

The wafer W, that has been polished by the first polishing unit 70A and/or the second polishing unit 70B, is then transported to the primary cleaning unit 100, where the wafer W is cleaned. This primary cleaning unit 100 is configured to scrub the wafer W by bringing a pair of rotating roll-type cleaning tools (e.g., roll sponges) into contact with the upper surface and the lower surface of the wafer W while rotating the wafer W. During scrubbing of the wafer W, a cleaning liquid (e.g., pure water) is supplied onto the wafer W. After the scrub-cleaning process, an etching liquid is supplied onto the upper surface and the lower surface of the wafer W to perform etching (i.e., chemical cleaning) on the upper surface and the lower surface of the wafer W, thereby removing residual metal ions.

The wafer W, that has been cleaned by the primary cleaning unit 100, is then sent to the secondary cleaning-drying unit 110. This secondary cleaning-drying unit 110 is a spin-drying unit having a cleaning function. More specifically, the secondary cleaning-drying unit 110 supplies a cleaning liquid (e.g., pure water) onto the upper surface of the wafer W while rotating the wafer W at a low speed. In this state, a rotating pencil-type cleaning tool is brought into contact with the upper surface of the wafer W to thereby scrub the wafer W. After the scrub-cleaning process, the wafer W is rotated at a high speed, whereby the wafer W is spin-dried.

The dried wafer W is then transported to the measuring unit 30, where the diameter of the wafer W is measured. The measuring unit 30 has, in addition to the diameter-measuring mechanism, an imaging module for taking an image of the periphery of the wafer W. This imaging module is part of a polished-state inspection unit for inspecting a surface of the polished wafer. Hereinafter, the polished-state inspection unit will be described in detail.

Figure 9:
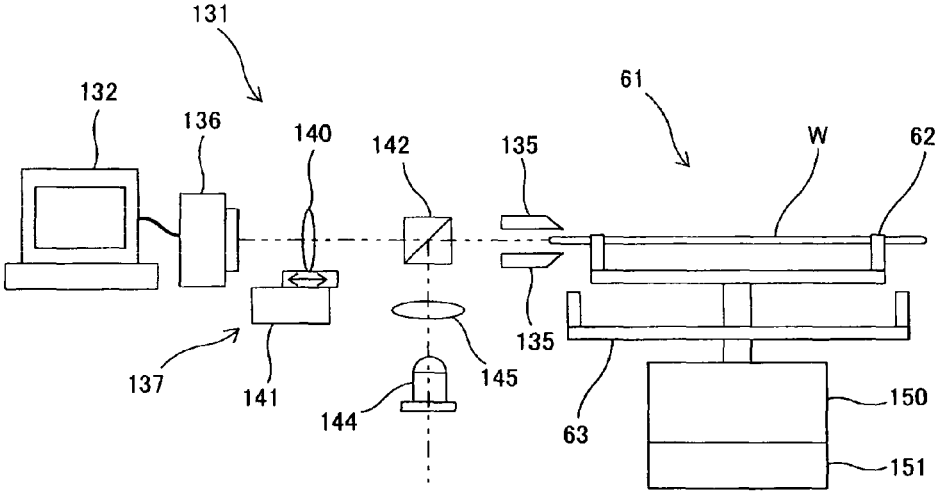
FIG. 9 is a schematic view showing a polished-state inspection unit.

FIG. 9 is a schematic view showing the polished-state inspection unit. This polished-state inspection unit is configured to determine whether or not a film (i.e., an object to be removed) has been removed from the periphery of the wafer by the polishing process based on an image taken by the imaging module. As shown in FIG. 9, the polished-state inspection unit includes the above-mentioned imaging module 131 and an image processing section 132 for analyzing an image taken by the imaging module 131. The imaging module 131 includes prisms 135 disposed so as to surround the periphery of the wafer W, an imaging camera 136 for taking an image of the periphery of the wafer W through the prisms 135, and a focusing lens unit 137 disposed between the prisms 135 and the imaging camera 136. A digital still camera having an image sensor (e.g., CCD) may be used as the imaging camera 136. The imaging camera 136 and the image processing section 132 are coupled to each other, and the image, taken by the imaging camera 136, is transmitted to the image processing section 132.

The wafer W is held by the above-described substrate holding rotary mechanism 61. This substrate holding rotary mechanism 61 has a stepping motor 150 for rotating the wafer W about its own axis via the upper chuck 62 and the lower chuck 63, and a rotary encoder (i.e., a position detector) 151 for detecting a rotational position or a rotational angle of the wafer W. In this embodiment, an absolute rotary encoder that detects an absolute position of the wafer W is used as the rotary encoder 151. The imaging module 131 is movable by a non-illustrated drive mechanism toward and away from the wafer W held by the substrate holding rotary mechanism 61.

The focusing lens unit 137 includes a lens 140 arranged on an optical axis and an actuator (e.g., a linear motor) 141 for a focusing operation. The actuator 141 is configured to move the lens 140 along the optical axis. The image processing section 132 and the actuator 141 are electrically connected. Based on a command from the image processing section 132, the actuator 141 moves the lens 140 such that the image is formed on the image sensor of the imaging camera 136. A general-purpose personal computer can be used as the image processing section 132.

A half mirror 142 is provided between the prisms 135 and the lens 140. Light is applied to the half mirror 142 from a light source (e.g., a white LED) 144. A lens 145 is disposed between the light source 144 and the half mirror 142. This lens 145 is provided for directing the light from the light source 144 to the periphery of the wafer W. The light from the light source 144 passes through the lens 145 and is reflected off the half mirror 142 to reach the periphery of the wafer W, whereby the periphery of the wafer W is brilliantly illuminated. The prisms 135 are arranged so as to face the upper portion and the lower portion of the periphery of the wafer W. Each of the prisms 135 has a property of adjusting an optical path length (or changing an optical path length). With use of the prisms 135, the respective images of the upper portion, the middle portion, and the lower portion of the periphery of the wafer W can be formed on the image sensor simultaneously. "Chrovit" distributed by Chrovit Japan Inc. or TECHNICAL Inc. can be suitably used as the prisms 135 having such a property.

Figure 10:
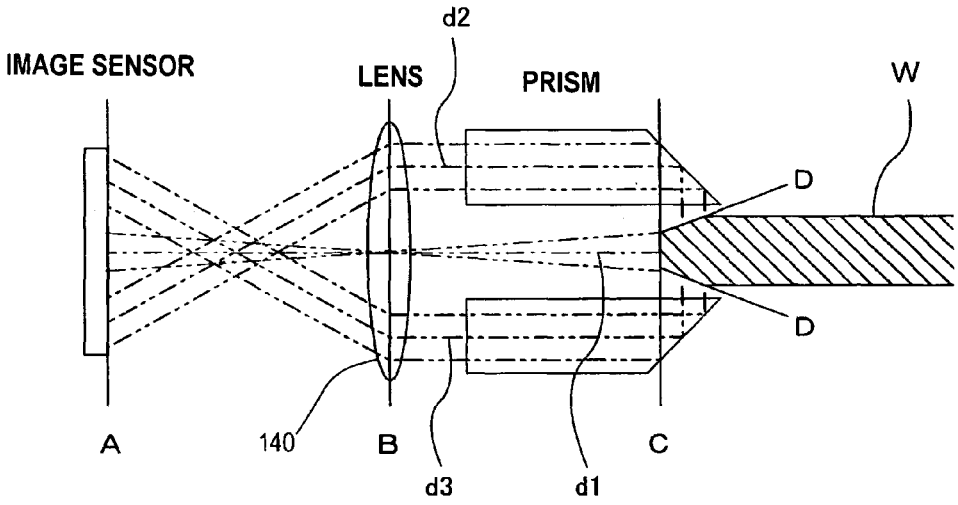
FIG. 10 is a schematic view illustrating optical paths of images.

Next, the function of the prisms 135 will be described in detail. FIG. 10 is a schematic view illustrating optical paths of the images. In FIG. 10, a plane A represents a surface of the image sensor of the imaging camera 136, a plane B represents a plane that passes through a center of the lens 140, a plane C represents the side portion (i.e., the apex) of the bevel portion of the wafer W, and planes D represent the upper slope and the lower slope of the bevel portion. The planes A, B, and C are parallel to each other. The plane A and the plane C are in a conjugate relationship by the lens 140. Specifically, an image on the plane C forms an image on the plane A. Images on the planes D are once reflected in the prisms 135 and directed to the lens 140. An optical path length d1 from the plane C to the plane A and optical path lengths d2, d3 from the plane D to the plane A through the prisms 135 are equal optically. This is because the optical path lengths d2, d3 are adjusted (shortened) by the prisms 135. In other words, the prisms 135 that are designed to equalize the optical path length d1 and the optical path lengths d2, d3 to each other are used in this embodiment. Because the optical path length d1 and the optical path lengths d2, d3 are equal, the image of the plane C and the images of the planes D are formed on the plane A (i.e., on the surface of the image sensor) by the lens 140.

An angle of the plane D is an angle of the bevel portion of the wafer and can vary depending on the type of wafer or the polished state (i.e., a degree of the polishing process). Consequently, the plane D and the plane A are not always parallel when the images are formed on the plane A, and the plane D in its entirety may not be focused on the plane A. In such a case, by increasing depth of focus of an optical system disposed between the plane D and the plane A, the image of the plane D can be formed on the plane A. One example of such a means for changing the depth of focus is to provide a diaphragm adjacent to the lens 140. Specifically, in FIG. 10, the diaphragm is disposed on the left side of the lens 140. The depth of the focus can be increased by reducing an aperture of the diaphragm.

The respective images of the upper portion, the middle portion, and the lower portion of the periphery of the wafer W are taken as images developed on the plane. The images of the upper portion and the lower portion of the periphery of the wafer W are taken by the imaging camera 136 through the prisms 135. On the other hand, the image of the middle portion of the periphery of the wafer W is taken by the imaging camera 136 directly without the prisms 135. As described above, the optical path length between the upper and lower portions of the periphery and the imaging camera 136 is equalized to the optical path length between the middle portion of the periphery and the imaging camera 136 by the prisms 135. Therefore, the imaging camera 136 can take the images of the peripheral portion of the wafer W from multiple directions simultaneously. In order to take better images, it is preferable to use the lens 140 of magnification such that the images are formed on the image sensor substantially in its entirety of the imaging camera 136.

Next, methods of taking images of the periphery of the wafer W using the above-described imaging module 131 will be described. The image-taking methods include a step-and-repeat method and a scan method. The step-and-repeat method is a method of taking still images of the periphery of the wafer W while rotating the wafer W intermittently, and the scan method is a method of taking accumulated images of the periphery of the wafer W while rotating the wafer W continuously. These methods will be described in detail below.

Figure 11:
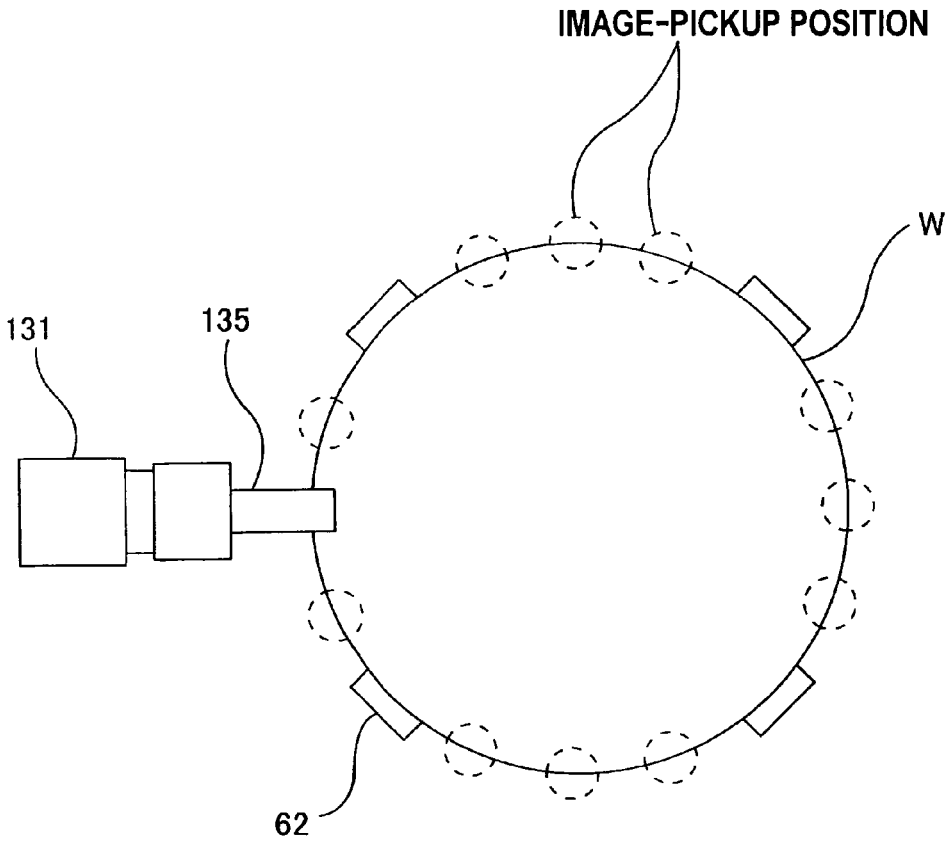
FIG. 11 is a view showing an example of image-pickup positions of a wafer in a step-and-repeat method.
Figure 12:
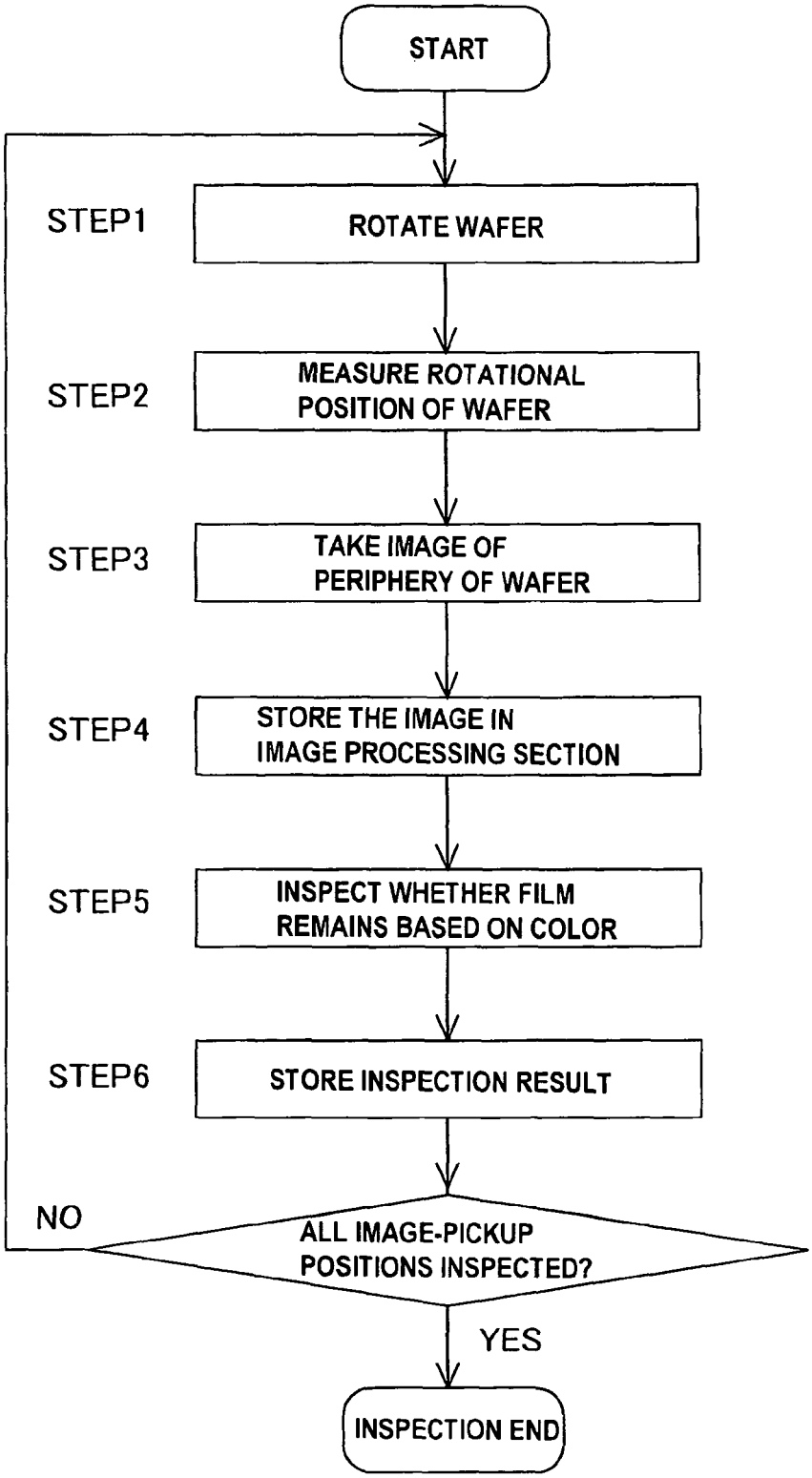
FIG. 12 is a flowchart showing operation sequence of the step-and-repeat method.

FIG. 11 is a view showing an example of image-pickup positions of the wafer in the step-and-repeat method, and FIG. 12 is a flowchart showing operation sequence of the step-and-repeat method. As shown in FIG. 11, in this method, plural image-pickup positions on the periphery of the wafer W are predetermined.

The image processing section 132 sends a command signal to the stepping motor 150, so that the stepping motor 150 rotates the wafer W (step 1). The rotational position of the wafer W is measured by the rotary encoder 151 (step 2). When the rotating wafer W reaches a predetermined image-pickup position, the rotation of the wafer W is stopped. Then, the imaging camera 136 takes an image of the periphery of the wafer W (step 3). The captured image is transmitted to the image processing section 132 and stored in a memory (i.e., a storage device) of the image processing section 132 (step 4). The image processing section 132 processes the image according to an image processing method, which will be described later, to inspect the presence or absence of a residual film (step 5). The inspection result is stored in the memory of the image processing section 132 (step 6). Each image-pickup position is recorded (or registered) in the image processing section 132 in association with the rotational position or the rotational angle of the wafer W. The information indicating the position where the image was taken is transmitted from the rotary encoder 151 to the image processing section 132, and this positional information is stored in the memory together with the corresponding image. Therefore, information of the residual film, such as a position and a size (an area) thereof, can be obtained from the image taken by the camera 136. The information including the presence or absence of the residual film and the position of the residual film are stored as the inspection result in the memory.

The above-described steps from the rotation of the wafer W (step 1) to the storage of the inspection result (step 6) are repeated until the inspection is conducted at all of the image-pickup positions. In this manner, the still images of the periphery of the wafer W are taken while the wafer W is rotated and stopped repetitively. The image-pickup positions may be set only in part of the periphery of the wafer W, or may be set over the entire circumference of the wafer W. From the viewpoint of reliability of the inspection result, it is preferable to set the image-pickup positions over the entire circumference of the wafer W.

Figure 13A:
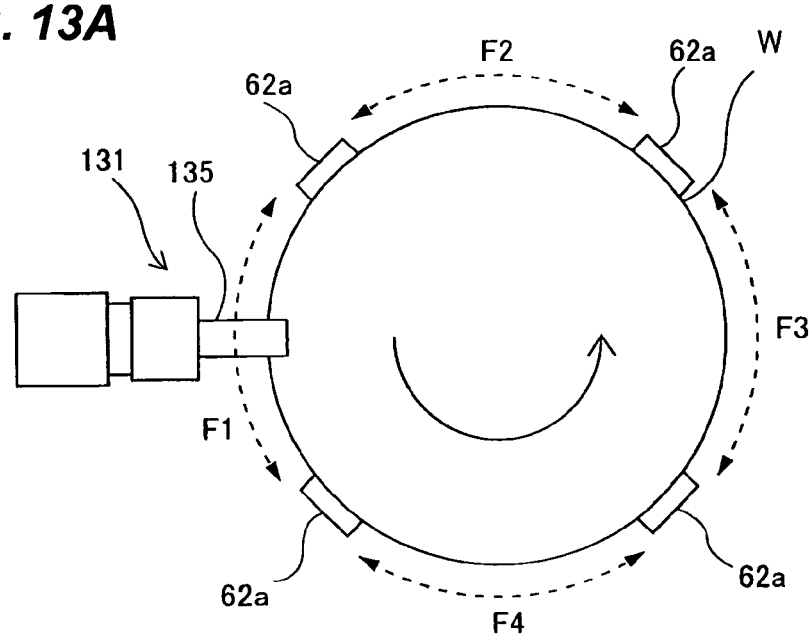
FIG. 13A and FIG. 13B are views each showing an example of image-pickup positions of a wafer in a scan method.
Figure 13B:
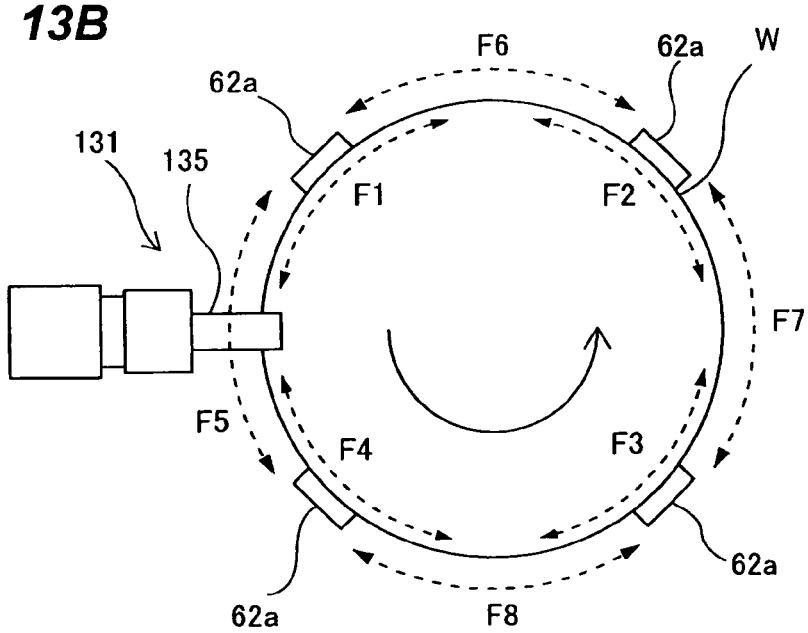
Figure 14:
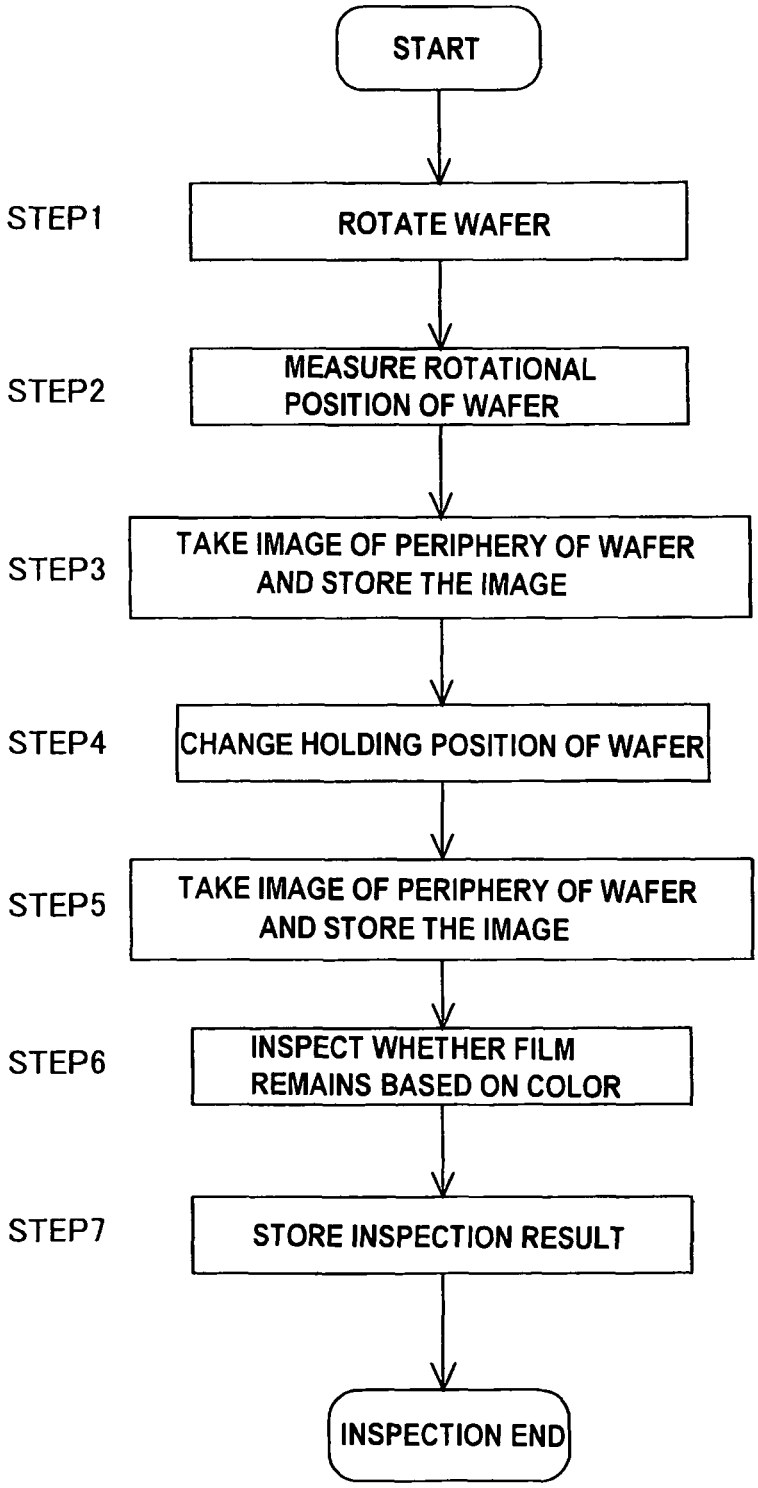
FIG. 14 is a flowchart showing operation sequence of the scan method.

FIGS. 13A and 13B are views each showing an example of image-pickup positions of the wafer in the scan method, and FIG. 14 is a flowchart showing operation sequence of the scan method. In this method, images of the periphery of the wafer W over its entire circumference are taken. The image processing section 132 sends a command signal to the stepping motor 150, so that the stepping motor 150 rotates the wafer W (step 1). The rotational position of the wafer W is measured by the rotary encoder 151 (step 2).

At the same time as the rotation of the wafer W is started, the imaging camera 136 starts taking the image of the periphery of the wafer W (step 3). While the wafer W is being rotated, the image sensor of the imaging camera 136 is exposed continuously. When the craw 62*a* of the upper chuck 62 is about to reach the position of the prisms 135, the imaging module 131 stops taking the image and moves away from the wafer W temporarily. After the craw 62*a* of the upper chuck 62 has passed the prisms 135, the imaging module 131 moves closer to the wafer W and starts taking the image of the periphery of the wafer W again. Such operations of taking the image and moving away from and toward the wafer W are repeated until the wafer W makes one revolution. The images, taken by the imaging camera 136, are sent to the image processing section 132 and stored in the memory of the image processing section 132. In the example shown in FIG. 13A, the upper chuck 62 has four claws 62*a*. Therefore, the imaging camera 136 repeats taking the image four times to thereby obtain images of four regions F1, F2, F3, and F4.

After the image-taking operation is completed, the rotation of the wafer W is stopped and the imaging module 131 is moved to its idle position once. Then, the lower chuck 63 is elevated to hold the wafer W, whereby the wafer W is transferred from the upper chuck 62 to the lower chuck 63. In this state, the upper chuck 62 is rotated through 45 degrees and then the lower chuck 63 is lowered, whereby the wafer W is held by the upper chuck 62 at a different position (step 4). Thereafter, the imaging module 131 moves toward the wafer W and starts taking the image at the same time as the wafer W is rotated. The imaging module 131 repeats the operations of taking the images and moving away from the wafer in the same manner as described above until the wafer W makes one revolution (step 5). More specifically, as shown in FIG. 13B, the imaging camera 136 repeats taking the image four times to thereby obtain images of four regions F5, F6, F7, and F8 which overlap the above-mentioned regions F1, F2, F3, and F4. In this manner, the images of the periphery of the wafer W in its entirety are obtained. The images obtained are transmitted to the image processing section 132 and stored in the memory of the image processing section 132.

In this scan method, the image sensor is exposed continuously while rotating the wafer W. Therefore, an accumulated image of the periphery of the wafer W is obtained. The image processing section 132 processes the image according to the image processing method which will be described later, and inspects whether or not the film remains on the periphery of the wafer W (step 6). The inspection result is stored in the memory of the image processing section 132 (step 7).

A line scan camera may be used as the imaging camera 136. The line scan camera is a camera configured to capture linear images successively and arrange the captured images sequentially to create a wide image (or a horizontally-long image). In this case also, the information indicating a position where each image was taken is transmitted from the rotary encoder 151 to the image processing section 132, and this positional information is stored in the memory together with the corresponding image. Use of the line scan camera makes it possible to specify an accurate position and a size of the residual film.

The step-and-repeat method and the scan method may be used in combination. For example, high-speed inspection can be performed by the scan method and then more precise inspection can be performed by the step-and-repeat method. In order to observe the position and size of the residual film, it is necessary to capture a still image of the wafer. Therefore, in this case, the above-described step-and-repeat method is used, or a combination of the scan method and the line scan camera is used.

It is also possible to conduct high-speed inspection at a relatively small number of image-pickup positions and then conduct further inspection at a relatively large number of image-pickup positions to accurately inspect a position and a size of the residual film by the step-and-repeat method. Similarly, multistage inspection including high-speed inspection and precise inspection can be performed by the scan method.

The image processing section 132 has an image display device which can display the images saved in the memory. The image display device may be provided independently of the image processing section 132. As previously described, each image is stored in the memory in association with the rotational position or rotational angle of the wafer W that indicates the position of the image. Therefore, an image in a desired position can be displayed on the image display device. Further, when the image processing section 132 judges that the film still remains at a certain position, the image processing section 132 can command the imaging module 131 to take an image at the same position again and can display the captured image on the image display device.

Figure 15:
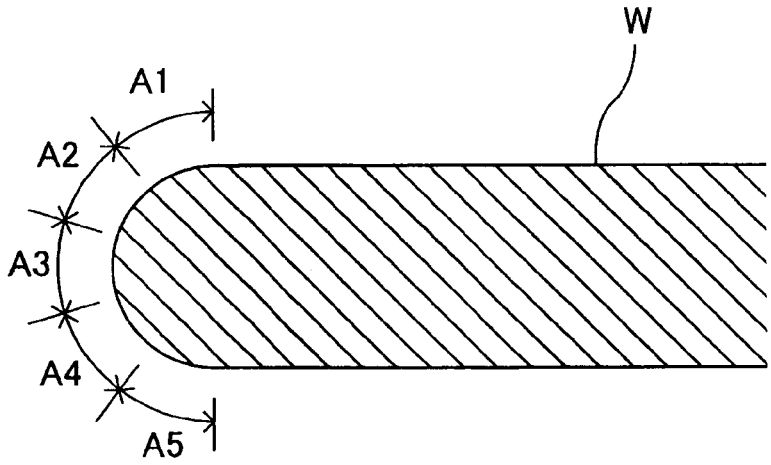
FIG. 15 is a view illustrating five regions defined on the bevel portion of the wafer.

Next, the image processing method and the polished-state inspection method by the image processing section 132 will be described. In the below-described example, the above-described polishing unit is used to perform five-stage polishing on five areas A1, A2, A3, A4, and A5 which are separately defined in the bevel portion of the wafer W, as shown in FIG. 15. Specifically, the bevel polishing head 85 is inclined in a manner as shown in FIG. 8A through FIG. 8C to polish the areas A1, A2, A3, A4, and A5 successively. Although the bevel portion is polished in this example, the near-edge portions can also be polished as well. The polished wafer W is cleaned by the primary cleaning unit 100 and further cleaned and dried by the secondary cleaning-drying unit 110. The dried wafer W is transported to the measuring unit 30, where the images of the periphery of the wafer W are captured by the imaging module 131 as described previously.

Figure 16:
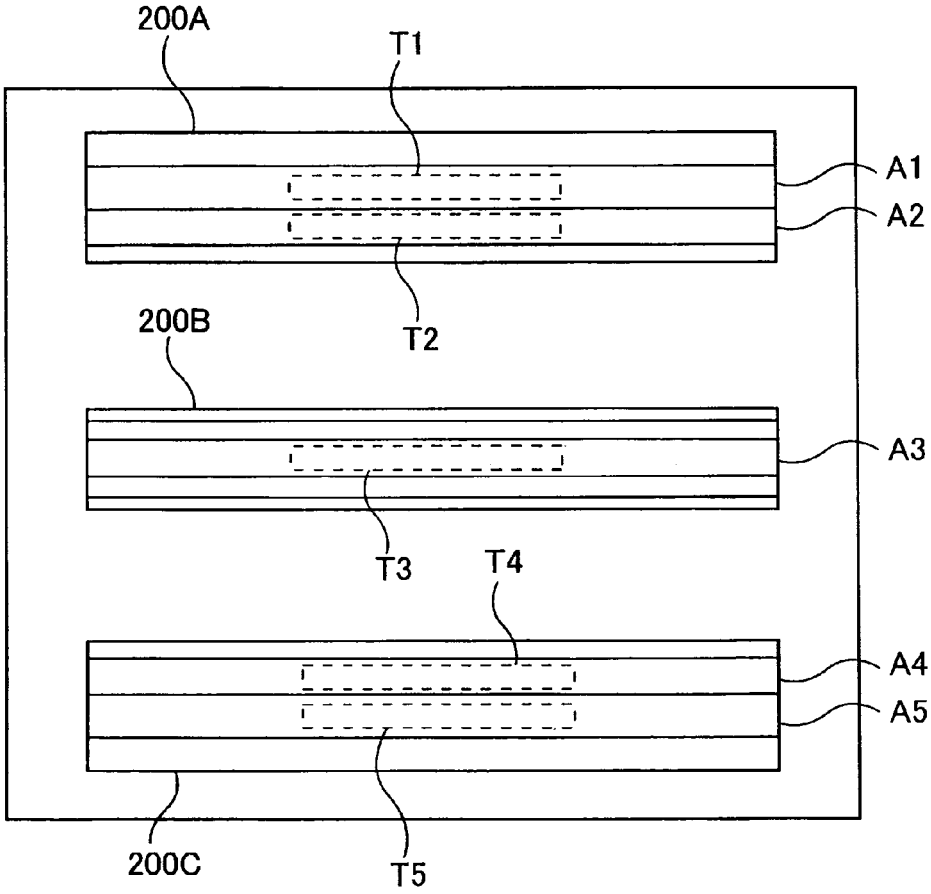
FIG. 16 is a schematic view illustrating images of the periphery of the wafer taken by an imaging module.

FIG. 16 is a schematic view illustrating images of the periphery of the wafer taken by the imaging module. Reference numeral 200A represents an image of the periphery of the wafer captured through the upper prism 135, reference numeral 200B represents an image of the periphery of the wafer captured directly without the prisms 135, and reference numeral 200C represents an image of the periphery of the wafer captured through the lower prism 135.

As shown in FIG. 16, images of the areas A1 and A2 located in the upper portion of the bevel portion are captured by the imaging camera 136 through the upper prism 135, an image of the area A3 located in the middle portion of the bevel portion is captured by the imaging camera 136 directly with no prism intervening between the wafer W and the camera 136, and images of the areas A4 and A5 located in the lower portion of the bevel portion are captured by the imaging camera 136 through the lower prism 135. The imaging camera 136 can take the three images 200A, 200B, and 200C simultaneously in one field of view, and an adjustment of focus can also be performed simultaneously.

Specific regions to be monitored by the image processing section 132 are set in the areas A1, A2, A3, A4, and A5, respectively. Hereinafter, these specific regions will be referred to as target regions T1, T2, T3, T4, and T5. The image processing section 132 monitors colors of these target regions T1, T2, T3, T4, and T5 and determines whether or not the film has been removed based on change in the colors. The target regions T1, T2, T3, T4, and T5 to be selected are regions which most suitably represent the polished-state of the areas A1, A2, A3, A4, and A5. Plural target regions may be set in one area.

Next, a method of processing the image by the image processing section 132 for determining whether or not the film has been removed will be described. As described above, the image processing section 132 determines removal of the film based on the color of the target region. A predetermined target color is registered in advance in the image processing section 132. The image processing section 132 determines that the film has been removed when the color of the target region matches the preset target color. More specifically, the image processing section 132 determines that the film has been removed when the number of pixels of the target color in the target region is larger than a predetermined threshold or smaller than a predetermined threshold.

Figure 17:
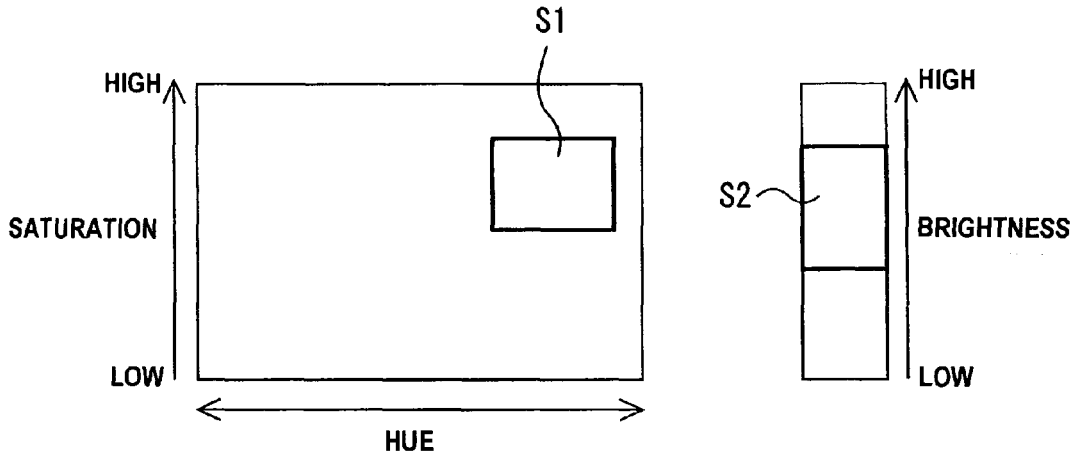
FIG. 17 is a view showing a color chart and a brightness chart for use in setting of a target color.

Typically, the target color can be selected from either a color of an exposed surface that appears as a result of polishing of the wafer (e.g., a color of silicon) or a color of an object to be removed (e.g., a color of $SiO_2$ or SiN). The color to be selected is not limited to a single color, and multiple colors can be selected. FIG. 17 is a view showing a color chart and a brightness chart for use in setting of the target color. As shown in FIG. 17, the color chart has a horizontal axis representing hue and a vertical axis representing saturation. The brightness chart has a vertical axis representing a degree of brightness. The target color can be determined from color information (hue, saturation, brightness) specified by a scope S1 located in the color chart and a scope S2 located in the brightness chart.

Figure 18:
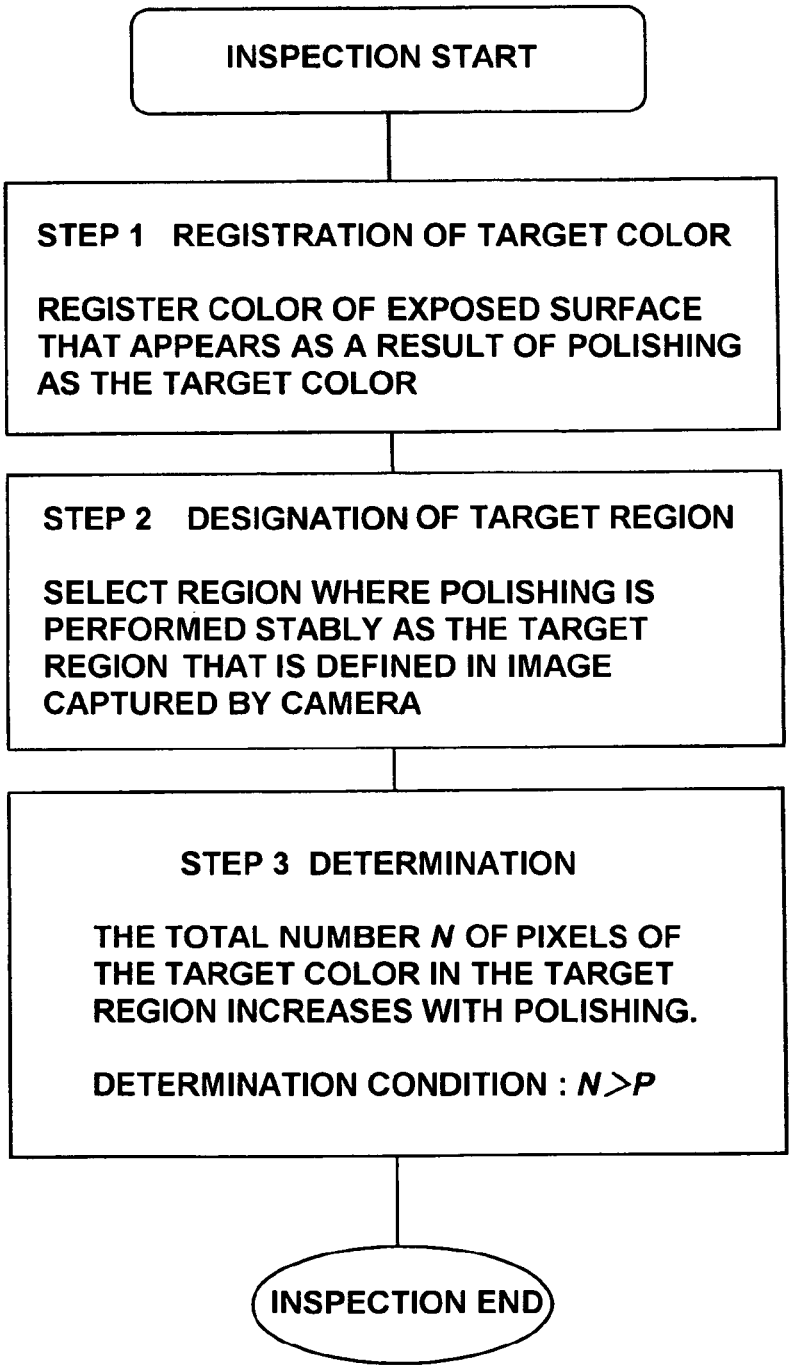
FIG. 18 is a diagram illustrating a film-removal determining process in a case where a color of silicon is selected as the target color.

With reference to FIG. 18, a film-removal determining process in a case where the color of silicon is selected as the target color will be described below. First, the color of silicon (typically white) is registered as the target color in the image processing section 132 (step 1). As described above, the color to be selected is not limited to a single color, and multiple colors can be selected. Next, the target region is specified (step 2). Then, if the number N of pixels of the target color in the target region is larger than a predetermined threshold P, the image processing section 132 determines that the film has been removed by the polishing process. This is because, when the film is removed by the polishing process, the color of the underlying silicon appears on the exposed surface. On the other hand, if the number N of pixels of the target color in the target region is equal to or smaller than the predetermined threshold P, the image processing section 132 determines that the film remains on the wafer W (step 3).

Figure 19:
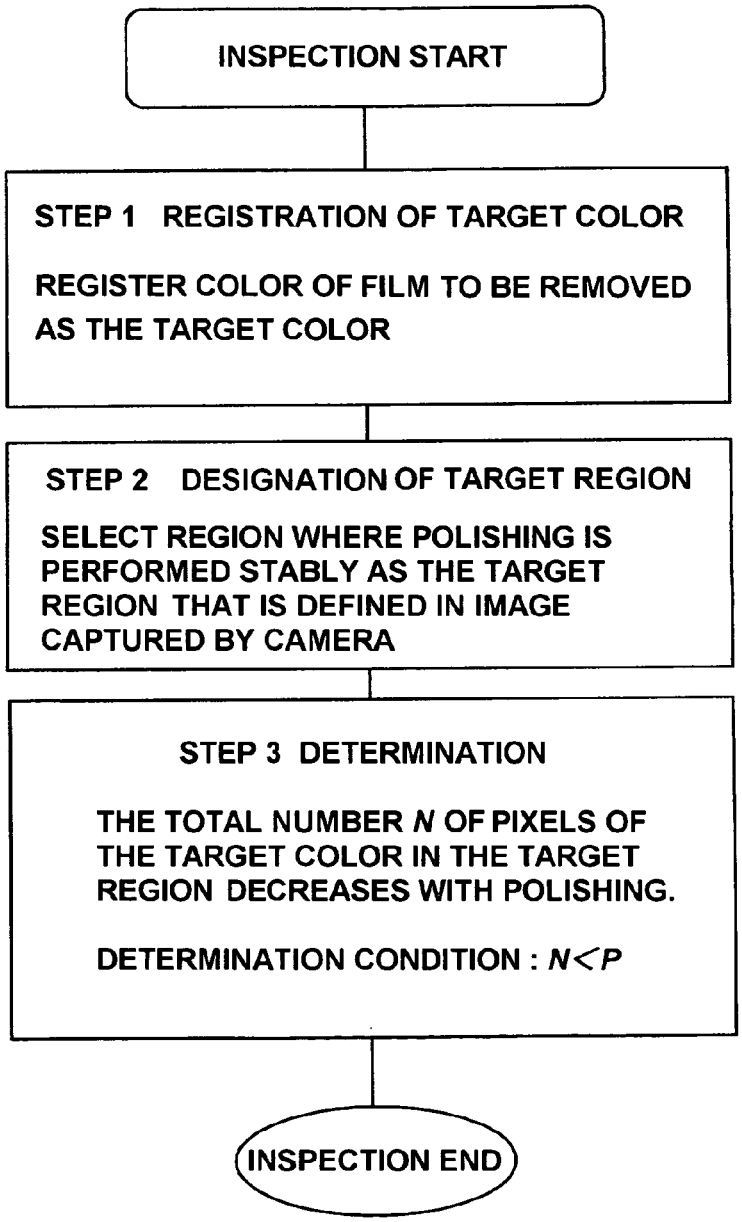
FIG. 19 is a diagram illustrating a film-removal determining process in a case where a color of a film to be removed is selected as the target color.

FIG. 19 is a diagram showing a film-removal determining process in a case where the color of the film to be removed is selected as the target color. First, the color of the film to be removed is registered as the target color in the image processing section 132 (step 1). As described above, the color to be selected is not limited to a single color, and multiple colors can be selected. Next, the target region is specified (step 2). Then, if the number N of pixels of the target color in the target region is smaller than a predetermined threshold P, the image processing section 132 determines that the film has been removed by the polishing process. This is because, when the film is removed by the polishing process, the color of the film disappears. On the other hand, if the number N of pixels of the target color in the target region is equal to or larger than the predetermined threshold P, the image processing section 132 determines that the film remains on the wafer W (step 3).

The inspection results are transmitted to the polishing-condition determining section 120 and used for determining the polishing conditions. For example, in the case where the image processing section 132 has determined that the film remains on the wafer, this inspection results is reflected on the polishing conditions (e.g., a polishing time and a force of pressing the polishing tape) for a subsequent wafer. Because the inspection results are obtained for the five areas A1, A2, A3, A4, and A5, the polishing conditions can be changed for these five areas in accordance with the inspection results. It is preferable to return the wafer, still having the residual film, to the polishing unit 70A or 70B and polish it again. In this case, the polishing time can be set to be shorter than the polishing time of the first polishing process.

The above-described example is directed to the method of inspecting the polished-state (i.e., the polished surface) based on the change in color of the image captured. Alternatively, a surface roughness of the periphery of the wafer can be detected from the image captured. Hereinafter, a method of detecting the surface roughness of the periphery of the wafer will be described.

In order to detect the surface roughness, it is necessary to capture a still image of the wafer. Therefore, in the surface-roughness detecting method, it is preferable to use the above-described step-and-repeat method or a combination of the scan method and the line scan camera.

The image, taken by the imaging camera 136, is sent to the image processing section 132, where image processing is performed. Specifically, the target region (T1 to T5) is extracted from the image, and the extracted color image is converted into a black-and-white image. Next, in order to emphasize the surface roughness, the black-and-white image is subjected to differential processing by applying a differentiation filter. Then the resultant image is displayed on a histogram. This histogram has a horizontal axis representing a brightness and a vertical axis representing the number of pixels.

Figure 20A:
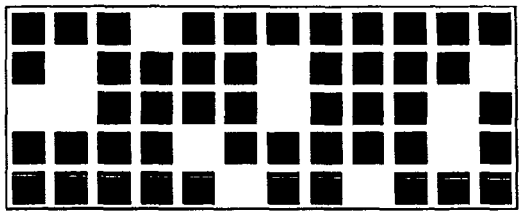
FIG. 20A is a schematic view showing an image of the periphery of the wafer with a rough surface and showing the image that has been subjected to a differential processing.
Figure 20B:
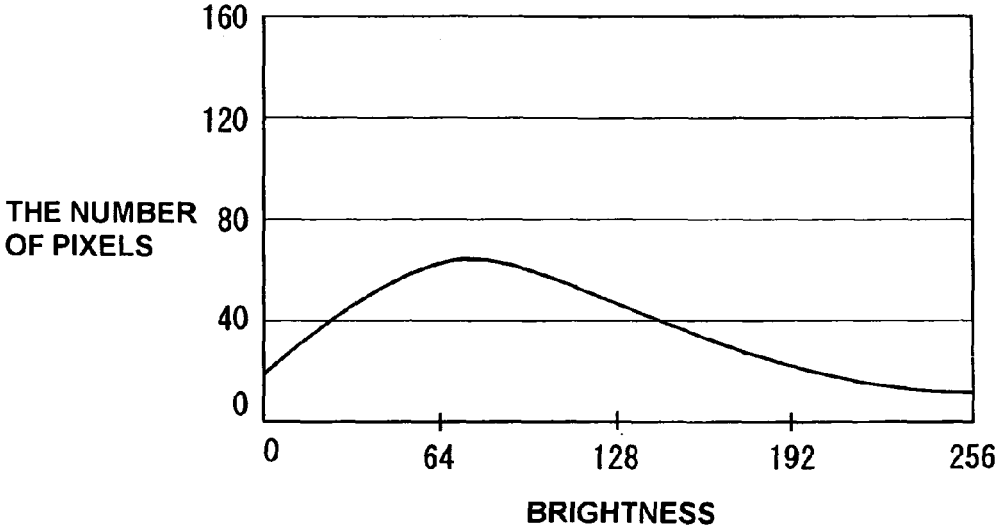
FIG. 20B is a histogram that numerically expresses the image shown in FIG. 20A.

FIG. 20A is a schematic view showing an image of the periphery of the wafer with a rough surface and showing the image that has been subjected to the differential processing. FIG. 20B is a histogram that numerically expresses the image shown in FIG. 20A. As shown in FIG. 20A, when the polished surface of the wafer W is rough, white areas indicating surface irregularities appear on the image. The surface roughness can be expressed as a numerical value on the histogram. Specifically, when the polished surface is rough, a lot of white areas appear in the image. As a result, the number of pixels of high brightness increases on the histogram.

Figure 21A:
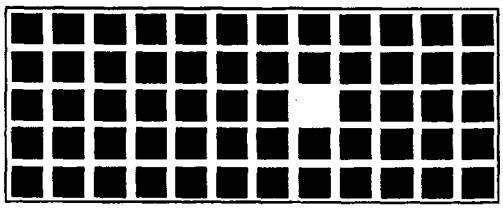
FIG. 21A is a schematic view showing an image of the periphery of the wafer with a smooth surface and showing the image that has been subjected to a differential processing.
Figure 21B:
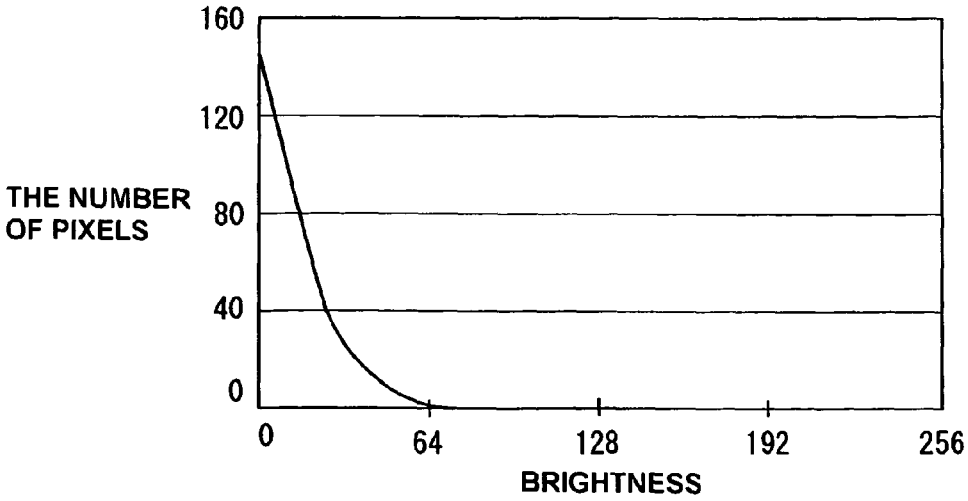
FIG. 21B is a histogram that numerically expresses the image shown in FIG. 21A.

On the other hand, FIG. 21A is a schematic view showing an image of the periphery of the wafer with a smooth surface and showing the image that has been subjected to the differential processing. FIG. 21B is a histogram that numerically expresses the image shown in FIG. 21A. As shown in FIG. 21A, when the polished surface of the wafer W is smooth, white areas indicating surface irregularities hardly appear on the image. As a result, the number of pixels of low brightness increases on the histogram. Therefore, the image processing section 132 can determines that the surface of the periphery of the wafer W is smooth when the number of pixels of predetermined brightness is larger than a preset value (e.g., when the number of pixels of brightness in the range of 0 to 64 is larger than 1000), or smaller than a preset value (e.g., when the number of pixels of brightness of 64 or more is smaller than 10).

Figure 22:
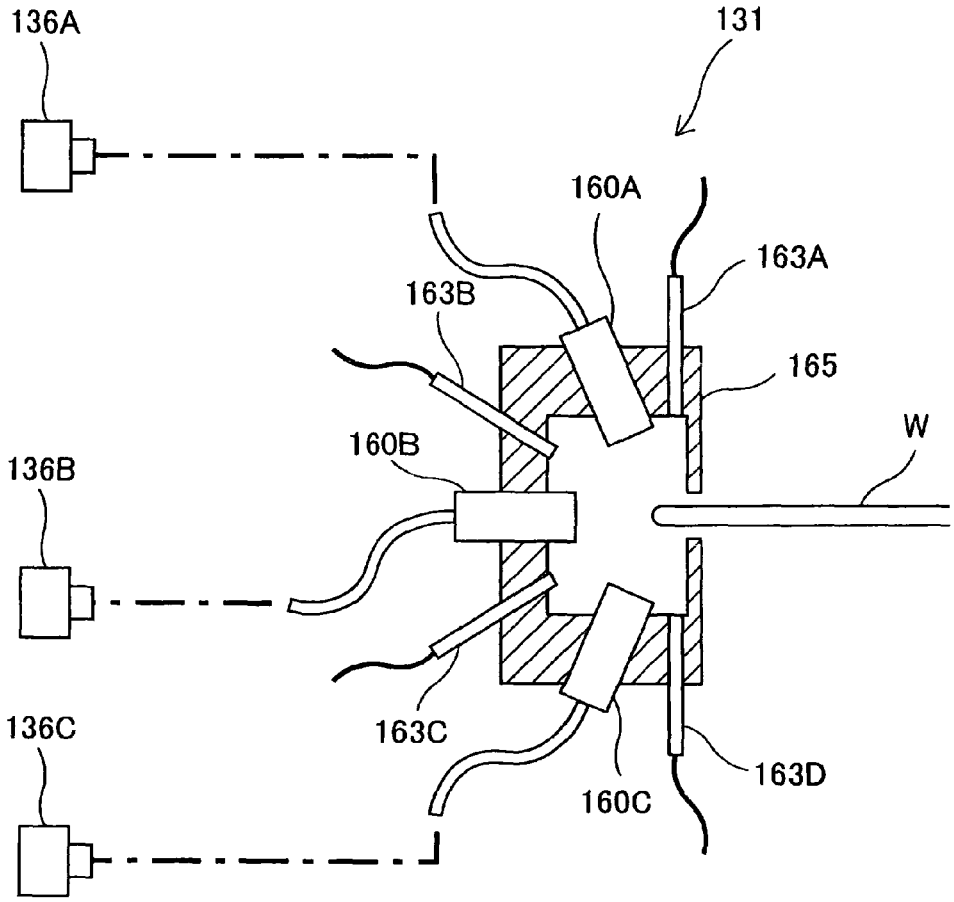
FIG. 22 is a view showing a modified example of the imaging module.

Next, a modified example of the imaging module 131 will be described with reference to FIG. 22. As shown in FIG. 22, the above-described prisms 135 are not used in this modified example. Instead, plural imaging cameras are used to take images of the periphery of the wafer W from multiple directions. As shown in FIG. 22, the imaging module 131 in this example includes plural terminal image-pickup elements (e.g., objective lenses) 160A, 160B, and 160C and imaging cameras 136A, 136B, and 136C coupled to the terminal image-pickup elements 160A, 160B, and 160C, respectively, via optical fibers.

The terminal image-pickup element 160A is located above the wafer W, the terminal image-pickup element 160B is located laterally of the wafer W, and the terminal image-pickup element 160C is located below the wafer W Illuminators 163A, 163B, 163C, and 163D are disposed next to the terminal image-pickup elements 160A, 160B, and 160C. The terminal image-pickup elements 160A to 160C and the illuminators 163A to 163D are secured to a support member 165. Although not shown in FIG. 22, the imaging cameras 136A, 136B, and 136C are coupled to the image processing section 132.

All the terminal image-pickup elements 160A to 160C and the illuminators 163A to 163D are arranged so as to face the periphery of the wafer W. More specifically, the terminal image-pickup element 160A faces the upper portion of the periphery of the wafer W, the terminal image-pickup element 160B faces the middle portion of the periphery of the wafer W, and the terminal image-pickup element 160C faces the lower portion of the periphery of the wafer W. With these arrangements, the images of the upper portion, the middle portion, and the lower portion of the periphery of the wafer W are taken by the imaging cameras 136A to 136C through the terminal image-pickup elements 160A to 160C. The images captured are transmitted to the image processing section 132 and are processed in accordance with the above-described method.

Figure 23A:
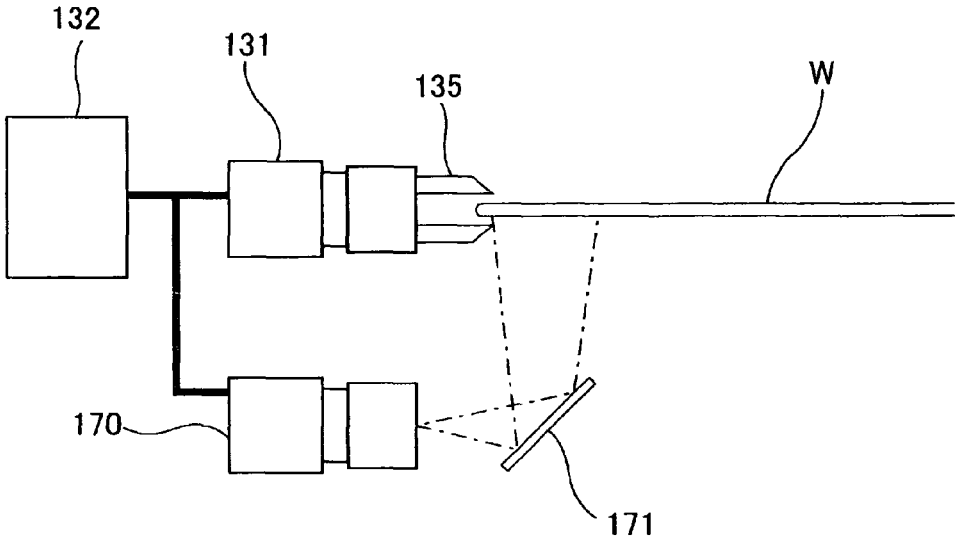
FIG. 23A is a schematic view showing another modified example of the imaging module.

FIG. 23A is a schematic view showing another modified example of the imaging module. In this example, in addition to the imaging module 131 shown in FIG. 9, a second imaging module 170 for taking an image of the rear surface of the wafer W is provided. This second imaging module 170 has a mirror 171, instead of the above-described prisms 135. The second imaging module 170 has a wider field of view (image-pickup coverage) than that of the first imaging module 131. Other structures are identical to those of the first imaging module 131. The mirror 171 is movable together with an imaging camera (see FIG. 9) of the second imaging module 170 in unison. The image of the rear surface of the wafer W is reflected off the mirror 171 to change its direction, and captured by the second imaging module 170. Although not shown in the drawing, the wafer W is held by the substrate holding rotary mechanism 61.

Figure 23B:
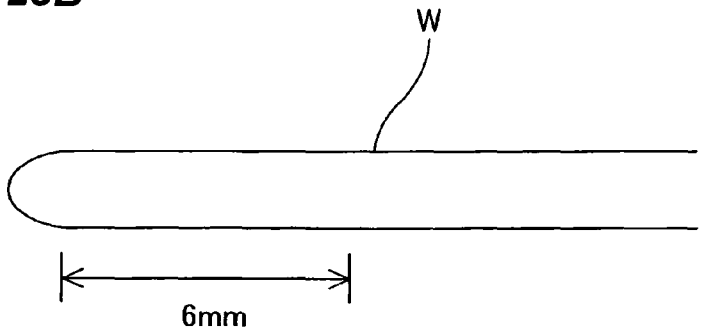
FIG. 23B is a schematic view showing a region taken by a second imaging module.

FIG. 23B is a schematic view showing a region to be photographed by the second imaging module 170. The region to be photographed by the second imaging module 170 is a flat surface located radially inwardly of the bevel portion and including the back near-edge portion. A width of the region is about 6 mm. The second imaging module 170 moves in conjunction with the first imaging module 131 and takes the image at the same timing. The image captured by the second imaging module 170 is transmitted to the image processing section 132 and are processed in accordance with the above-described method.

While the imaging module 131 is incorporated in the measuring unit 30 in the above-described embodiment, the present invention is not limited to this arrangement. For example, the imaging module 131 and the substrate holding rotary mechanism 61 may be provided as one unit independently of other units. The substrate holding rotary mechanism may be of attraction type that holds the rear surface of the wafer by an attraction force (e.g., a vacuum suction).

Other examples of the measuring unit to be incorporated in the substrate processing apparatus include a measuring unit for measuring other physical quantity, such as a shape or temperature of the wafer. The above-described imaging module 131 can be provided in such a measuring unit which measures a predetermined physical quantity of the wafer in a dry state. Further, the above-described imaging module 131 can also be provided in a post-processing unit for performing a post-process, such as a drying process, on the wafer. For example, the imaging module 131 may be incorporated in the secondary cleaning-drying unit 110, so that the polished state can be inspected after drying of the wafer W. Further, plural imaging cameras and plural terminal image-pickup elements may be provided separately in plural units (e.g., in the measuring unit 30 and the secondary cleaning-drying unit 110).

While it is preferable that the imaging module 131 inspect the wafer W after the wafer W is cleaned and dried, the present invention is not limited to this manner. For example, the imaging module 131 may be provided in the first polishing unit 70A and/or the second polishing unit 70B. In this case, when the bevel polishing head 85 is polishing the wafer W, the imaging module 131 is in a location away from the wafer W, and when the bevel polishing head 85 moves away from the wafer W, the imaging module 131 moves toward the wafer W and takes the image of the periphery of the wafer W. According to these operations, even if the multiple bevel polishing heads 85 are provided around the wafer W, the bevel polishing heads 85 and the imaging module 131 do not contact and the respective processes do not interfere with each other.

The imaging module 131 of in-line type is configured to take the image of the wafer W when the polishing process is not being performed. For example, after polishing of the wafer W is completed, the imaging module 131 provided inside or outside the polishing unit may take the image of the periphery of the wafer W. Alternatively, the imaging module 131 provided in the polishing unit may take the image of the periphery of the wafer W when polishing of the wafer W is stopped temporarily, and after taking the image, polishing of the wafer W may be performed again.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims and equivalents.

What is claimed is:

1. A substrate processing apparatus comprising:

a polishing unit configured to polish a periphery of a substrate;

an imaging module configured to take an image of the periphery of the substrate polished by said polishing unit;

an image processing section configured to inspect a polished state of the substrate based on the image taken by said imaging module; and a polishing-condition determining section configured to determine a polishing condition in said polishing unit;

wherein said imaging module is configured to take the image of the periphery of the substrate from multiple directions when said polishing unit is not polishing the periphery of the substrate;

wherein said imaging module includes prisms to be disposed adjacent to the periphery of the substrate and an imaging camera for taking the image of the periphery of the substrate through said prisms;

wherein said prisms are configured to adjust a second optical path length between an upper portion of the periphery of the substrate and said imaging camera, and to adjust a third optical path length between a lower portion of the periphery of the substrate and said imaging camera such that the second optical path length and the third optical path length are equal to a first optical path length between a middle portion of the periphery of the substrate and said imaging camera;

wherein said imaging camera is arranged to take the image of the middle portion of the periphery directly without said prisms and to take the image of the upper portion of the periphery and the image of the lower portion of the periphery through said prisms;

wherein an inspection result of said image processing section is transmitted to said polishing-condition determining section; and wherein said polishing-condition determining section is configured to determine the polishing condition in said polishing unit based on the inspection result.

2. The substrate processing apparatus according to claim 1, wherein said image processing section is configured to inspect the polished state of the substrate based on a color of the image taken by said imaging module.

3. The substrate processing apparatus according to claim 2, wherein said image processing section is configured to quantify the color of the image taken by said imaging module to express the image in a numerical value, and further configured to determine that an object has been removed from the periphery when the numerical value is larger than or smaller than a preset threshold.

4. The substrate processing apparatus according to claim 1, further comprising a substrate holding rotary mechanism for rotating the substrate about its own central axis, wherein said imaging module is disposed adjacent to the periphery of the substrate held by said substrate holding rotary mechanism, and said imaging module is configured to take the image of the periphery of the substrate while said substrate holding rotary mechanism rotates the substrate intermittently or continuously.

5. The substrate processing apparatus according to claim 4, wherein said imaging module is configured to take a still image of the periphery of the substrate.

6. The substrate processing apparatus according to claim 4, wherein said imaging module is configured to take an accumulated image of the periphery of the substrate.

7. The substrate processing apparatus according to claim 4, wherein said imaging camera is a line scan camera.

8. The substrate processing apparatus according to claim 1, further comprising a measuring unit configured to measure a predetermined physical quantity of the substrate polished by said polishing unit, wherein said imaging module is incorporated in said measuring unit.

9. The substrate processing apparatus according to claim 8, wherein:

said measuring unit has a substrate holding rotary mechanism for rotating the substrate about its own central axis; and said imaging module is disposed adjacent to the periphery of the substrate held by said substrate holding rotary mechanism.

10. The substrate processing apparatus according to claim 1, further comprising at least one post-processing unit configured to perform a post-process on the substrate polished by said polishing unit, wherein said imaging module is incorporated in said at least one post-processing unit.

11. The substrate processing apparatus according to claim 10, wherein:

said at least one post-processing unit has a substrate holding rotary mechanism for rotating the substrate about its own central axis; and said imaging module is disposed adjacent to the periphery of the substrate held by said substrate holding rotary mechanism.

12. The substrate processing apparatus according to claim 1, further comprising a storage device for storing an inspection result of said image processing section.

13. The substrate processing apparatus according to claim 1, further comprising:

a storage device for storing the image taken by said imaging module; and an image display device for displaying the image stored in said storage device.

14. The substrate processing apparatus according to claim 13, wherein:

said storage device stores the image and information indicating a position where the image was taken; and said image display device is configured to display an image in a position requested.

15. The substrate processing apparatus according to claim 1, wherein said prisms are configured to shorten the second optical path length and the third optical path length.

16. The substrate processing apparatus according to claim 1, wherein said prisms are arranged to face the upper portion and the lower portion of the periphery of the substrate, respectively.

* * * * *